US008844728B2

(12) United States Patent
James et al.

(10) Patent No.: US 8,844,728 B2
(45) Date of Patent: Sep. 30, 2014

(54) SHIPPING AND DISPLAY CONTAINER AND BLANK FOR FORMING SAME

(75) Inventors: Jeffrey Scott James, Elmhurst, IL (US); Matthew Kiev Swenson, Wood Dale, IL (US); Paul Michael Connolly, Jr., Westfield, MA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 0 days.

(21) Appl. No.: 13/422,503

(22) Filed: Mar. 16, 2012

(65) Prior Publication Data

US 2012/0234724 A1 Sep. 20, 2012

Related U.S. Application Data

(60) Provisional application No. 61/454,389, filed on Mar. 18, 2011, provisional application No. 61/477,074, filed on Apr. 19, 2011.

(51) Int. Cl.
*B65D 25/54* (2006.01)
*B65D 5/54* (2006.01)

(52) U.S. Cl.
CPC ..... *B65D 5/5445* (2013.01)
USPC ..... 206/774; 206/779; 206/781; 206/772; 206/750; 229/235; 229/117.16; 229/160.1; 229/240

(58) Field of Classification Search
CPC ..... B65D 5/5445
USPC ..... 206/774, 779, 781, 772, 750; 229/235, 229/117.16, 160.1, 240
See application file for complete search history.

(56) References Cited

U.S. PATENT DOCUMENTS

| | | | | |
|---|---|---|---|---|
| 1,986,101 | A * | 1/1935 | Brodsky | 229/242 |
| 3,542,192 | A | 11/1970 | Steck | |
| 3,669,251 | A | 6/1972 | Phillips, Jr. | |
| 3,917,158 | A | 11/1975 | Dorofachuk et al. | |
| 3,927,761 | A | 12/1975 | Boyle | |
| 3,942,631 | A | 3/1976 | Sutherland et al. | |
| 3,961,706 | A * | 6/1976 | Roccaforte et al. | 206/736 |
| 4,363,400 | A | 12/1982 | Lewis | |
| 4,946,042 | A | 8/1990 | Ferreri et al. | |
| 5,076,491 | A | 12/1991 | Freudentahl et al. | |
| 5,167,324 | A | 12/1992 | Miller | |

(Continued)

OTHER PUBLICATIONS

International Search Report and Written Opinion, dated Jul. 2, 2012, for co-pending PCT patent application No. PCT/US2012/034256.

*Primary Examiner* — Anthony Stashick
*Assistant Examiner* — James M Van Buskirk
(74) *Attorney, Agent, or Firm* — Armstrong Teasdale LLP

(57) ABSTRACT

A container formed from a blank of sheet material includes, in an exemplary embodiment, opposing side walls, a front end wall, a back end wall, a top wall, and a bottom wall. An opening lip extends from a portion of the bottom of the front wall. Perforation lines extend diagonally from each end of the lip. Each perforation line extends to a side wall. Each side wall includes a perforation line extending from one of the front wall perforation lines to the upper corner of the sidewall adjacent the back end wall. Access holes are located in each side wall adjacent to the side wall perforation line. Another perforation line extends the width of the back end wall and intersects each of the perforation lines of the side walls.

29 Claims, 38 Drawing Sheets

(56) References Cited

U.S. PATENT DOCUMENTS

| | | | | |
|---|---|---|---|---|
| 5,368,194 | A | 11/1994 | Oliff et al. | |
| 5,505,369 | A | 4/1996 | Taliaferro | |
| 5,507,430 | A | 4/1996 | Imhoff | |
| 5,651,497 | A | 7/1997 | Ventura et al. | |
| 5,690,213 | A | 11/1997 | Matsumura | |
| 5,842,576 | A | 12/1998 | Snow | |
| 5,881,884 | A | 3/1999 | Podosek | |
| 5,918,801 | A | 7/1999 | Milio | |
| 5,957,294 | A | 9/1999 | Kanter | |
| 6,073,833 | A | 6/2000 | Desrosiers et al. | |
| 6,189,780 | B1 | 2/2001 | Kanter | |
| 6,209,786 | B1 | 4/2001 | Yelton et al. | |
| 6,386,369 | B2 * | 5/2002 | Yuhas et al. | 206/746 |
| 6,402,021 | B1 | 6/2002 | Heathcock | |
| 6,409,077 | B1 | 6/2002 | Telesca et al. | |
| 6,435,351 | B1 * | 8/2002 | Gibb | 206/736 |
| 6,478,159 | B1 | 11/2002 | Taylor et al. | |
| 6,510,982 | B2 | 1/2003 | White et al. | |
| 6,554,135 | B1 | 4/2003 | Luceri et al. | |
| 6,832,683 | B2 | 12/2004 | Boriani et al. | |
| 6,918,487 | B2 * | 7/2005 | Harrelson | 206/427 |
| 7,066,333 | B2 * | 6/2006 | Justice | 206/738 |
| 7,175,066 | B2 | 2/2007 | Varanasi | |
| 7,225,930 | B2 * | 6/2007 | Ford et al. | 206/746 |
| 7,568,611 | B2 | 8/2009 | Cargile, Jr. | |
| 7,628,746 | B2 | 12/2009 | Varanasi | |
| 7,703,666 | B2 | 4/2010 | Hand et al. | |
| 7,717,324 | B2 | 5/2010 | Keefe, Jr. | |
| 7,870,994 | B2 | 1/2011 | Spivey, Sr. et al. | |
| 7,992,716 | B2 * | 8/2011 | Jackson | 206/738 |
| 8,011,567 | B2 | 9/2011 | DeBusk et al. | |
| 8,028,839 | B2 | 10/2011 | Learn | |
| 8,061,587 | B2 | 11/2011 | Blin | |
| 2006/0054676 | A1 | 3/2006 | Wischusen, III | |
| 2011/0284624 | A1 | 11/2011 | DeBusk et al. | |

* cited by examiner

SHIPPING AND DISPLAY CONTAINER AND BLANK FOR FORMING SAME

CROSS REFERENCE TO RELATED APPLICATIONS

This application claims the priority of U.S. Provisional Patent Application Ser. No. 61/454,389, filed Mar. 18, 2011, which is hereby incorporated by reference in its entirety. This application also claims the priority of U.S. Provisional Patent Application Ser. No. 61/477,074, filed Apr. 19, 2011, which is hereby incorporated by reference in its entirety.

BACKGROUND OF THE INVENTION

The field of the invention relates generally to a container, and more particularly to a container that includes lines of perforation for removal of a portion of the container for displaying articles for sale.

It is a known practice to employ containers to store and transport sales articles from the manufacturer to the place of sale, such as a retail store. Typically, containers are formed from at least one blank made of corrugated paperboard which is suitably cut, scored and folded to produce a generally rectangular shaped box. Once the carton reaches the place of sale, the articles are unpackaged from the carton and are typically placed on display shelves. One drawback of such containers is that a significant amount of labor is required to remove the articles from the container and, in turn, place them on the display shelves.

It is known that some containers can be utilized to ship the sales articles and are convertible into a display device at the place of sale, thereby eliminating the labor required in transferring the articles from the container to the shelves of the place of sale. Such containers normally include a separable upper section which is torn away from the lower section by a tear strip or perforated tear line formed through panels of the container to expose the packaged articles for display. However, these containers that are convertible to display devices typically have sides and bottom lips on the front of the display devices that make it difficult to see the entire front of the article for sale.

Accordingly, it is desirable to provide a container that is convertible to a display and that includes small bottom corners on the front of the display that facilitates the sales articles from falling out of the display and that permits customers to see the front of the sales articles.

BRIEF DESCRIPTION OF THE INVENTION

In one aspect, a blank of sheet material for forming a container is provided. The blank includes a front end panel, a first side panel, a second side panel, and a back end panel connected in series by a plurality of side fold lines. A front bottom panel extends at least partially from a bottom edge of the front end panel. An opening lip extends from the front end panel across the front bottom edge. The opening lip has a free edge and two opposite ends. The free edge of the opening lip is adjacent to the bottom front panel. Each end of the opening lip is a distance from the side fold lines of the front end panel. A first separation line extends from a first end of the opposite ends of the opening lip toward the first side panel. A second separation line extends from a second end of the opposite ends of the opening lip toward the second side panel.

In another aspect, a shipping container convertible to a display container, formed from the just-described blank, is also provided.

In yet another aspect, a shipping container convertible to a display container is provided. The shipping container includes a front end wall, a first side wall, a second side wall, a top wall, a bottom wall, and a back end wall. An opening lip extends from the front end wall across a front bottom region of the front end wall. The opening lip has a free edge and two opposite ends. The free edge of the opening lip is adjacent to a front region of the bottom wall. Each end of the opening lip is a distance from side regions of the front end panel. A first separation line extends from a first end of the opposite ends of the opening lip toward the first side wall; and a second separation line extends from a second end of the opposite ends of the opening lip toward the second side wall.

In still yet another aspect, a method for forming a shipping container convertible to a display container is provided. The shipping container is formed from a blank having a front end panel, a first side panel, a second side panel, and a back end panel connected in series by a plurality of fold lines. The back end panel extends from one of the first and second side panels. Top and bottom panels extend from opposite edges of each of the front end panel, first side panel, second side panel, and back end panel, respectively. An opening lip extends from the front end panel. The opening lip has two opposite ends. First and second separation lines extend from the opposite ends of the opening lip to opposing ones of the first side panel, the second side panel, the front top end panel and the front bottom end panel. Third and fourth separation lines extend from the first and second separation lines, respectively, through one pair of the first and second side panels, and the front top end panel and the front bottom end panel, respectively. At least a fifth separation line is disposed in one of the first side panel, the second side panel and the back end panel.

The method includes first rotating the back end panel toward an interior surface of one of the first and second side panels, rotating the one of the first and second side panels toward the front end panel, rotating the front end panel toward the other of the first and second side panels. The method further includes rotating a glue flap, extending from one of the rear end panel and the other of the first and second side panels toward the other of the rear end panel and the other of the first and second side panels and affixing the glue flap thereto, forming a rectangular tube. The method further includes rotating the first and second bottom side panels toward the interior of the rectangular tube, then rotating the front bottom end panel and the back bottom end panel, toward the interior of the tube, and affixing the front bottom end panel and the back bottom end panel in place. The method further includes rotating the first and second top side panels toward the interior of the rectangular tube, followed by the front top end panel and the back bottom end panel, which are likewise affixed in place. Opening of the container so formed is accomplished by grasping the opening lip and pulling, causing an upper portion of the container to separate from a lower portion of the container along the lines of separation.

DETAILED DESCRIPTION OF THE INVENTION

Figure 1:
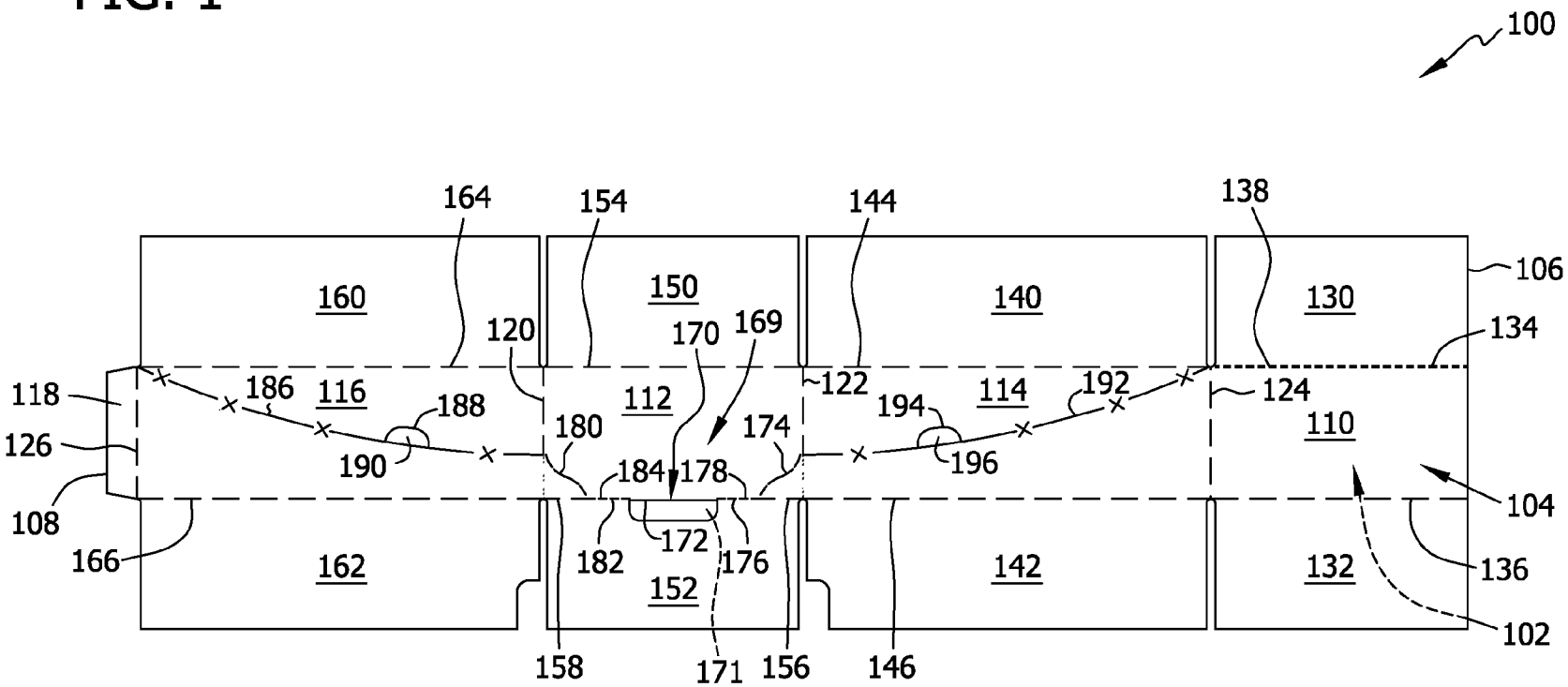
FIG. 1 is top plan schematic illustration of a blank of sheet material of an exemplary embodiment of the present invention.

The following detailed description illustrates the disclosure by way of example and not by way of limitation. The description clearly enables one skilled in the art to make and use the disclosure, describes several embodiments, adaptations, variations, alternative, and use of the disclosure, including what is presently believed to be the best mode of carrying out the disclosure.

A container that includes lines of perforation for removal of a portion of the container for displaying articles for sale, and a blank used for forming the container is described below in detail. The container is constructed from a blank of sheet material using a machine and/or by hand. For example, the blank can be wrapped about a mandrel to form the container or formed using a tray former machine. Alternatively, a folder/glue machine can be used to convey the blank through folder arms and an adhesive applicator to form a knocked-down flat container which can then be fully formed by hand. In another embodiment, the container can be formed by a machine as a wraparound container wherein the container is wrapped around a load of products contained within the container. In one embodiment, the container is fabricated from a paperboard material. The container, however, may be fabricated using any suitable material, and therefore is not limited to a specific type of material. In alternative embodiments, the container is fabricated using cardboard, fiberboard, paperboard, foamboard, corrugated paper, and/or any suitable material known to those skilled in the art and guided by the teachings herein provided.

In an exemplary embodiment, the container includes opposing side walls, a front end wall, a back end wall, a top wall, and a bottom wall. An opening assembly including a lip and access gap is included at the bottom of the front wall. The opening lip extends below the front bottom wall and creates an opening to permit a user to remove the upper portion of the container. In another embodiment, the opening lip extends to a point substantially even with the bottom wall. Perforation lines extend diagonally from each end of the lip. Each perforation line extends to a side wall. Each side wall includes a perforation line extending from one of the front wall perforation lines to the upper corner of the sidewall adjacent the back end wall. The perforation lines form separation regions that enable an upper portion of the container to be removed from the bottom portion of the container, which bottom portion serves as a display container for the articles contained therewithin. Access holes may be located in each side wall adjacent to the side wall perforation line. Another perforation line may extend the width of the back end wall and intersect each of the perforation lines of the side walls.

The container can be converted to a display by a user pulling on the opening lip of the bottom of the front wall to break the perforations of the diagonal perforation lines on the front end wall. The user is able to access the lip by inserting fingers within the access gap for pulling on the lip. Next, the user grasps the two side access holes and pulls outwardly to break the perforation lines on each side. Then the user breaks the line of perforations along the back of the container by pulling from either side to remove the top portion (removable portion) of the container.

Different embodiments described here can vary in size and/or dimensions although similar labels are used for each embodiment. For example, although a depth is labeled similarly throughout the description, each embodiment can have varying depths. In addition, each embodiment includes an opening assembly that is similar to the opening assembly described above.

Figure 2:
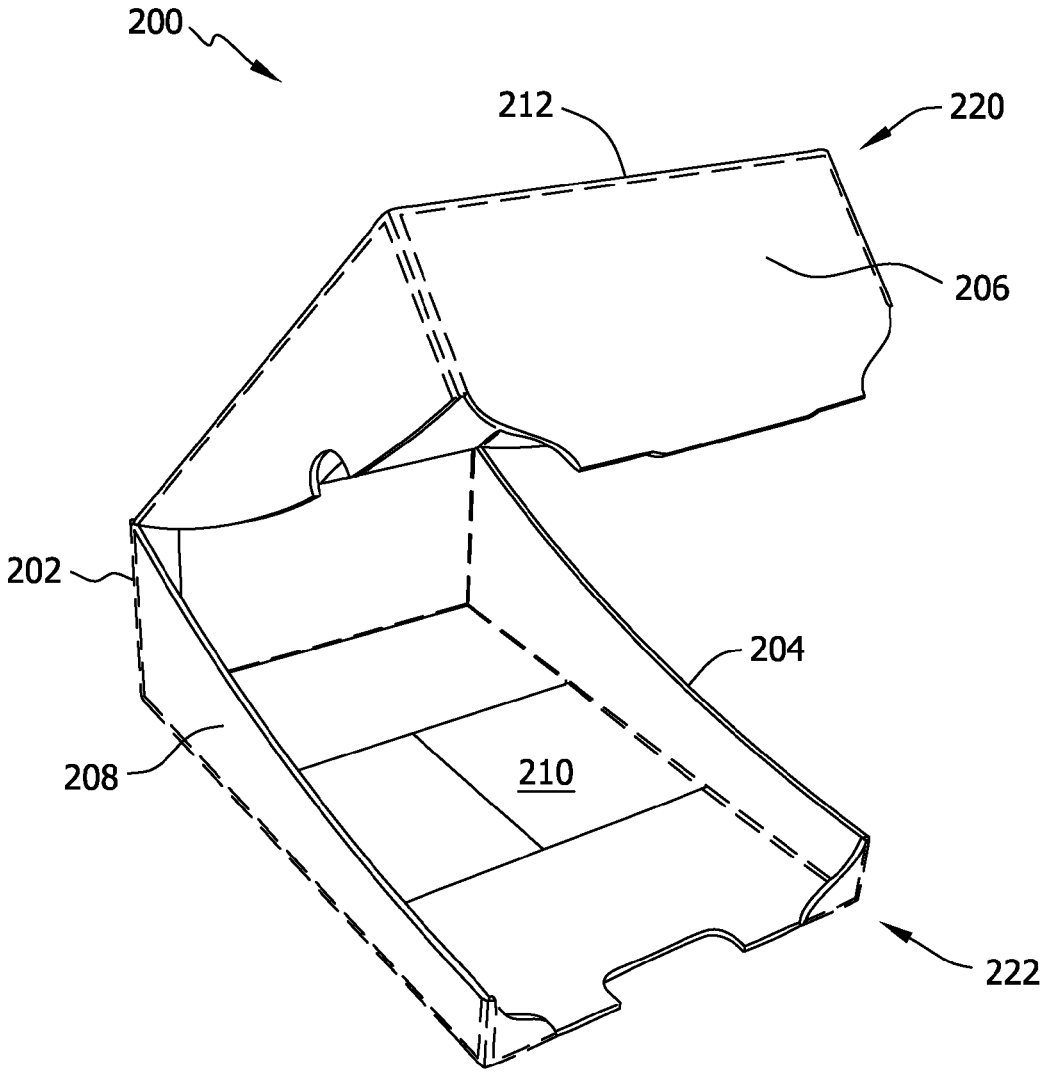
FIG. 2 is a perspective schematic illustration of a container formed from the blank shown in FIG. 1, and the container converted to a display container.

Referring now to the drawings, and more specifically to FIGS. 1 and 2, although as described above a container may have any suitable size, shape, and/or configuration, FIGS. 1 and 2 illustrate the construction or formation of one exemplary embodiment of a container. Specifically, FIG. 1 is a top plan view of an exemplary blank 100 of sheet material. FIG. 2 is a top perspective view of a container 200 formed from blank 100.

Referring to FIG. 1, blank 100 has a first or interior surface 102 and an opposing second or exterior surface 104. Further, blank 100 defines a leading edge 106 and an opposing trailing edge 108. In one embodiment, blank 100 includes, from trailing edge 108 to leading edge 106, a glue flap 118, a first side panel 116, a front end panel 112, a second side panel 114, and a back end panel 110, coupled together along preformed, generally parallel, fold lines 126, 120, 122, and 124, respectively. More specifically, first side panel 116 extends from front end panel 112 along fold line 120, second side panel 114 extends from front end panel 112 along fold line 122, back end panel 110 extends from second side panel 114 along fold line 124, and glue flap 118 extends from first side panel 116 along fold line 126. Fold lines 120, 122, 124, and/or 126, as well as other fold lines and/or hinge lines described herein, may include any suitable line of weakening and/or line of separation known to those skilled in the art and guided by the teachings herein provided.

First side panel 116 includes a first top side panel 160 and a first bottom side panel 162 extending therefrom along respective fold lines 164 and 166. More specifically, first top side panel 160 extends from first side panel 116 along fold line 164, and first bottom side panel 162 extends from first side panel 116 along fold line 166. Similarly, second side panel 114 includes a second top side panel 140 and a second bottom side panel 142 extending therefrom along respective fold lines 144 and 146. More specifically, second top side panel 140 extends from second side panel 114 along fold line 144, and second bottom side panel 142 extends from second side panel 114 along fold line 146.

Front end panel 112 includes a front top end panel 150 and a front bottom end panel 152 extending therefrom along respective fold lines 154, 156 and 158. More specifically, front top end panel 150 extends from front end panel 112 along fold line 154, and front bottom end panel 152 extends from front end panel 112 along fold lines 156 and 158. Similarly, back end panel 110 includes a back top end panel 130 and a back bottom end panel 132 extending therefrom along respective fold lines 134 and 136. More specifically, back top end panel 130 extends from back end panel 110 along fold line 134, and back bottom end panel 132 extends from back end panel 110 along fold line 136. Fold line 134 includes a perforation/cut line 138.

An opening assembly 169 includes a lip 170 extending from the bottom of front end panel 112 between fold lines 156 and 158, and an access gap 171. Cut line 172 defines opening lip 170. In the embodiment of FIGS. 1 and 2 (as with each of the embodiments shown and described herein), cut line 172 (or its equivalent in the other embodiments herein) preferably extends into the adjacent panel at least the thickness of the blank, or more, so that opening lip 170 extends beyond the bottom wall 210 of container 200 (FIG. 2) when erected from blank 100. In addition to enabling opening lip 170 to extend beyond the bottom of the erected container, the length of opening lip provides for the creation of a gap, between the opening lip and the leading edge of the bottom wall, for the insertion of fingers to facilitate grasping and lifting of opening lip (and, in turn, the upper portion of the erected container). Even if opening lip only extends to exactly the outer surface of the bottom wall of the erected container, a gap for finger insertion is still created. In embodiments (such as the embodiment of FIGS. 15 and 16) where there is a cut out positioned in the bottom wall (or other wall) immediately adjacent to the opening lip, the opening lip may or may not extend into the front bottom end panel.

A perforation line 174 extends diagonally from fold line 156 to fold line 122. Fold line 156 includes a portion 176 that includes a perforation/cut line 178. Portion 176 of fold line 156 extends from opening lip 170 to perforation line 174. Similarly, a perforation line 180 extends diagonally from fold line 158 to fold line 120. Fold line 158 includes a portion 182 that includes a perforation/cut line 184. Portion 182 of fold line 158 extends from opening lip 170 to perforation line 180.

First side panel 116 includes a perforation line 186 that extends from the intersection of perforation line 180 and fold line 120 to the junction of fold line 164 and fold line 126. In another embodiment, perforation line 186 extends from the intersection of perforation line 180 and fold line 120 to another location along trailing edge 108. Perforation line 186 includes a cut out 188 that defines an access opening 190 in first side panel 116. Cut out 188 is positioned on the upper side of perforation line 186.

Similarly, second side panel 114 includes a perforation line 192 that extends from the intersection of perforation line 174 and fold line 122 to the junction of fold line 144 and fold line 124. In other embodiment, perforation line 192 extends from the intersection of perforation line 174 and fold line 122 to another location along fold line 124. Perforation line 192 includes a cut out 194 that defines an access opening 196 in second side panel 114. Cut out 194 is positioned on the upper side of perforation line 192.

In addition, the exemplary embodiment may include a cut-out, score lines, or perforation lines on front bottom end panel 152 to facilitate a user to insert fingers within access gap 171 for pulling on opening lip 170.

Referring to FIG. 2, to construct container 200 from blank 100, back end panel 110 is rotated about fold line 124 toward interior surface 102 of second side panel 114, second side panel 114 is rotated about fold line 122 toward interior surface 102 of front end panel 112, front end panel 112 is rotated about fold line 120 toward interior surface 102 of first side panel 116, and glue flap 118 is rotated about fold line 126 toward interior surface 102 of back end panel 110. In the exemplary embodiment, after rotating panels 110, 112, 114, and 116 and glue flap 118 about fold lines 124, 122, 120, and 126, side panels 116 and 114 are substantially parallel to each other and substantially perpendicular to end panels 110 and 116. Panels 110, 112, 114, and 116 and glue flap 118 can be rotated about fold lines 124, 122, 120, and 126 by wrapping blank 100 about a mandrel within a machine or by using a tray folder machine. Alternatively, a folder/glue machine can be used to convey blank 100 through folder arms and an adhesive applicator to form a knocked-down flat container.

Once panels 110, 112, 114, and 116 and glue flap 118 are rotated about fold lines 124, 122, 120, and 126, glue flap 118 is coupled to back end panel 110. For example, in the exemplary embodiment, interior surface 102 of glue flap 118 is adhered to exterior surface 104 of back end panel 110. Alternatively, exterior surface 104 of glue flap 118 is adhered to interior surface 102 of back end panel 110. Further, although adhesive is described herein, glue flap 118 can be coupled to back end panel 110 using any suitable fastener and/or technique. Once glue flap 118 is coupled to back end panel 110, back end panel 110 and glue flap 118 form a back end wall 202, second side panel 114 forms a second side wall 204, front end panel 112 forms a front wall 206, and first side panel 116 forms first side wall 208 of container 200. From this configuration, partially formed container 200 can be collapsed into a knocked-down flat configuration for shipping and/or storage of container 200.

To continue construction of container 200, first bottom side panel 162 is rotated about fold line 166 toward interior surface 102 of first side panel 116, and second bottom side panel 142 is rotated about fold line 146 toward interior surface 102 of second side panel 114. In the exemplary embodiment, first bottom side panel 162 is substantially perpendicular to first side wall 208, and second bottom side panel 142 is substantially perpendicular to second side wall 204. Front bottom end panel 152 is rotated about fold lines 156 and 158 toward interior surface 102 of front end panel 112, and back bottom end panel 132 is rotated about fold line 136 toward interior surface 102 of back end panel 110. As such, bottom side panels 162 and 142 and bottom end panels 152 and 132 form a bottom wall 210 of container 200, as shown in FIG. 2.

To close container 200, front top end panel 150 is rotated about fold line 154 toward interior surface 102 of front end panel 112, and back top end panel 130 is rotated about fold line 134 toward interior surface 102 of back end panel 110. More specifically, after rotation, front top end panel 150 is substantially perpendicular to front end panel 112 and back top end panel 130 is substantially perpendicular to back end panel 110. First top side panel 160 is rotated about fold line 164 toward interior surface 102 of first side panel 116, and second top side panel 140 is rotated about fold line 144 toward interior surface 102 of second side panel 114. More specifically, after rotation, first top side panel 160 is substantially perpendicular to first side panel 116 and second top side panel 140 is substantially perpendicular to second side panel 114. In the exemplary embodiment, top side panels 160 and 140 overlap when top side panels 160 and 140 are substantially parallel to bottom wall 210. Alternatively, top side panels 160 and 140 are sized such that top side panels 160 and 140 do not overlap when top side panels 160 and 140 are substantially parallel to bottom wall 210. In the exemplary embodiment, top side panels 160 and 140 rest on top end panels 150 and 130 while at least top side panels 160 and 140 are secured together using, for example, tape. As such, interior surface 102 of top side panels 160 and/or 140 is adjacent to and/or in direct contact with exterior surface 104 of top end panels 150 and 130. Top side panels 160 and 140 and top end panels 150 and 130 define top wall 212 of container 200.

Once container 200 has been erected, filled and sealed, upon arrival at its destination, container 200 may be opened as follows: an operator grasps front wall 206 by placing their hand under lip 170 and pulling upwardly. Preferably, perforation lines 186, 180, 184, 178, 174, 192 and 138 are created in such a manner that all will yield in a simultaneous manner, so that upon a continuous upward pulling motion, the operator separates and removes an upper portion 220 of container 200 from a lower portion 222 of container 200.

Figure 3:
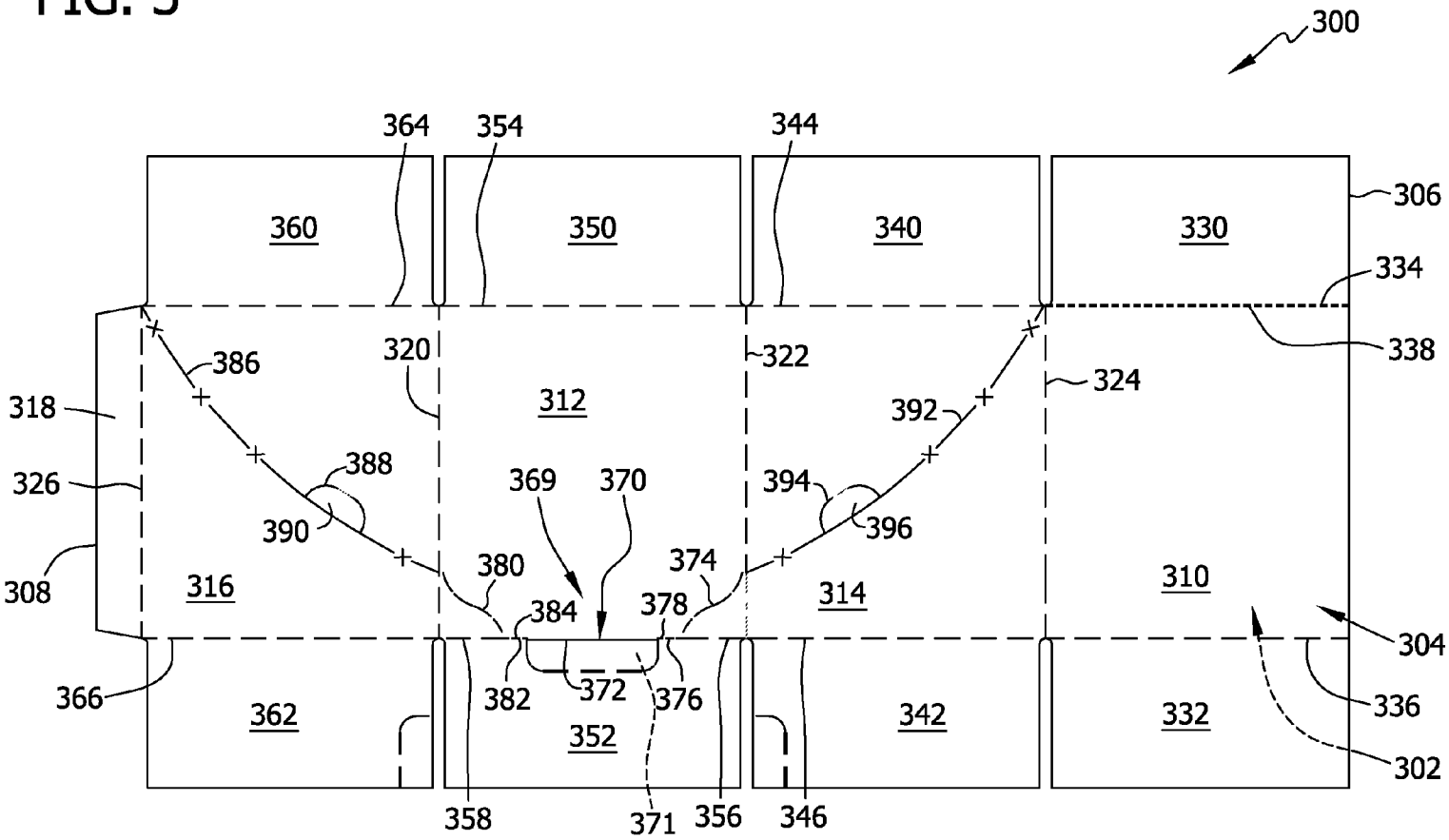
FIG. 3 is top plan schematic illustration of a blank of sheet material of a first alternate embodiment.
Figure 4:
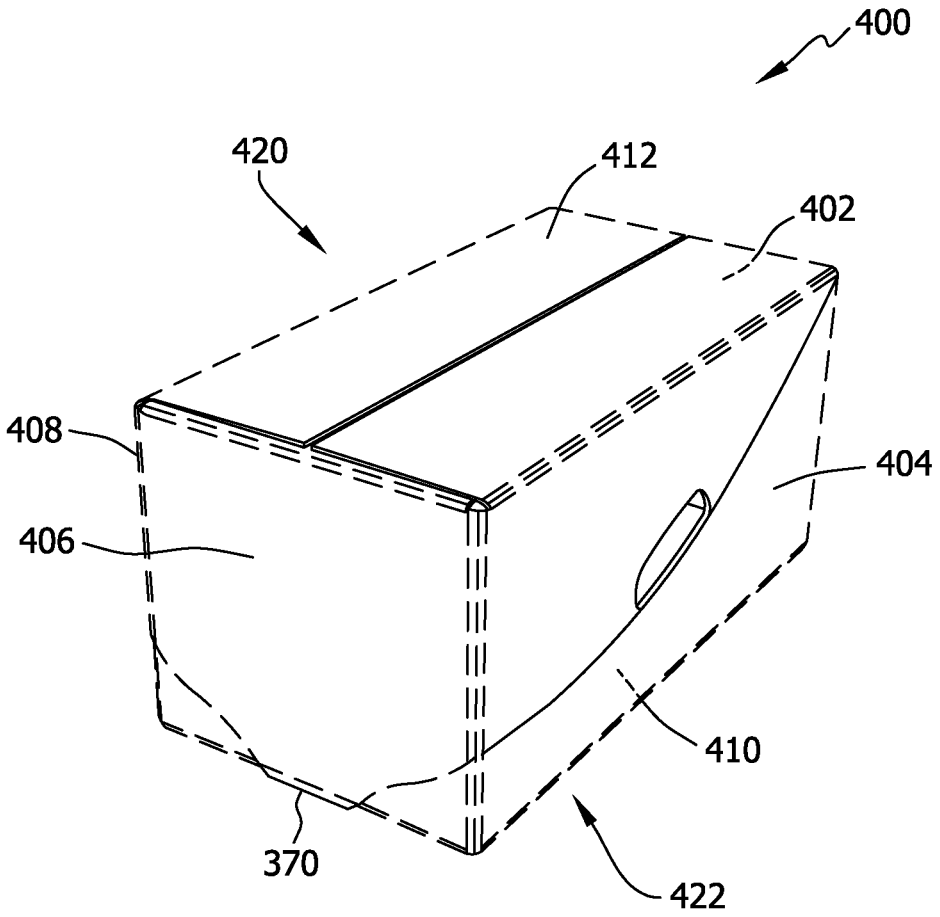
FIG. 4 is a perspective schematic illustration of a container formed from the blank shown in FIG. 3.

FIGS. 3 and 4 illustrate a blank, and a container made from that blank, according to a first alternative exemplary embodiment of a container. Specifically, FIG. 3 is a top plan view of an exemplary blank 300 of sheet material. FIG. 4 is a top perspective view of a container 400 formed from blank 300.

Referring to FIG. 3, blank 300 has a first or interior surface 302 and an opposing second or exterior surface 304. Further, blank 300 defines a leading edge 306 and an opposing trailing edge 308. In one embodiment, blank 300 includes, from trailing edge 308 to leading edge 306, a glue flap 318, a first side panel 316, a front end panel 312, a second side panel 314, and a back end panel 310, coupled together along preformed, generally parallel, fold lines 326, 320, 322, and 324, respectively. More specifically, first side panel 316 extends from front end panel 312 along fold line 320, second side panel 314 extends from front end panel 312 along fold line 322, back end panel 310 extends from second side panel 314 along fold line 324, and glue flap 318 extends from first side panel 316 along fold line 326. Fold lines 320, 322, 324, and/or 326, as well as other fold lines and/or hinge lines described herein, may include any suitable line of weakening and/or line of separation known to those skilled in the art and guided by the teachings herein provided.

First side panel 316 includes a first top side panel 360 and a first bottom side panel 362 extending therefrom along respective fold lines 364 and 366. More specifically, first top side panel 360 extends from first side panel 316 along fold line 364, and first bottom side panel 362 extends from first side panel 316 along fold line 366. Similarly, second side panel 314 includes a second top side panel 340 and a second bottom side panel 342 extending therefrom along respective fold lines 344 and 346. More specifically, second top side panel 340 extends from second side panel 314 along fold line 344, and second bottom side panel 342 extends from second side panel 314 along fold line 346.

Front end panel 312 includes a front top end panel 350 and a front bottom end panel 352 extending therefrom along respective fold lines 354, 356 and 358. More specifically, front top end panel 350 extends from front end panel 312 along fold line 354, and front bottom end panel 352 extends from front end panel 312 along fold lines 356 and 358. Similarly, back end panel 310 includes a back top end panel 330 and a back bottom end panel 332 extending therefrom along respective fold lines 334 and 336. More specifically, back top end panel 330 extends from back end panel 310 along fold line 334, and back bottom end panel 332 extends from back end panel 310 along fold line 336. Fold line 334 includes a perforation/cut line 338.

An opening assembly 369 includes a lip 370 extending from the bottom of front end panel 312 between fold lines 356 and 358, and access gap 371 created by opening lip 370. As discussed with respect to the embodiment of FIGS. 1 and 2, opening lip 370 preferably extends into front bottom end panel a length equal or greater to the thickness of blank 300, so as to extend beyond the bottom of the erected container.

Perforation line 372 enables opening lip 370 to be pushed in or removed entirely to permit an operator to reach opening lip 370. A perforation line 374 extends diagonally from fold line 356 to fold line 322. Fold line 356 includes a portion 376 that includes a perforation/cut line 378. Portion 376 of fold line 356 extends from opening lip 370 to perforation line 374.

Similarly, a perforation line 380 extends diagonally from fold line 358 to fold line 320. Fold line 358 includes a portion 382 that includes a perforation/cut line 384. Portion 382 of fold line 358 extends from opening lip 370 to perforation line 380.

First side panel 316 includes a perforation line 386 that extends from the intersection of perforation line 380 and fold line 320 to the junction of fold line 364 and fold line 326. In another embodiment, perforation line 386 extends from the intersection of perforation line 380 and fold line 320 to another location along trailing edge 308. Perforation line 386 includes a cut out 388 that defines an access opening 390 in first side panel 316. Cut out 388 is positioned on the upper side of perforation line 386.

Similarly, second side panel 314 includes a perforation line 392 that extends from the intersection of perforation line 374 and fold line 322 to the junction of fold line 344 and fold line 324. In other embodiment, perforation line 392 extends from the intersection of perforation line 374 and fold line 322 to another location along fold line 324. Perforation line 392 includes a cut out 394 that defines an access opening 396 in second side panel 314. Cut out 394 is positioned on the upper side of perforation line 392.

In addition, the exemplary embodiment may include a cut-out, score lines, or perforation lines on front bottom end panel 352 to facilitate a user to insert fingers within access gap 371 for pulling on opening lip 370.

Referring to FIG. 4, to construct container 400 from blank 300, back end panel 310 is rotated about fold line 324 toward interior surface 302 of second side panel 314, second side panel 314 is rotated about fold line 322 toward interior surface 302 of front end panel 312, front end panel 312 is rotated about fold line 320 toward interior surface 302 of first side panel 316, and glue flap 318 is rotated about fold line 326 toward interior surface 302 of back end panel 310. In the exemplary embodiment, after rotating panels 310, 312, 314, and 316 and glue flap 318 about fold lines 324, 322, 320, and 326, side panels 316 and 314 are substantially parallel to each other and substantially perpendicular to end panels 310 and 312. Panels 310, 312, 314, and 316 and glue flap 318 can be rotated about fold lines 324, 322, 320, and 326 by wrapping blank 300 about a mandrel within a machine or by using a tray folder machine. Alternatively, a folder/glue machine can be used to convey blank 300 through folder arms and an adhesive applicator to form a knocked-down flat container.

Once panels 310, 312, 314, and 316 and glue flap 318 are rotated about fold lines 324, 322, 320, and 326, glue flap 318 is coupled to back end panel 310. For example, in the exemplary embodiment, interior surface 302 of glue flap 318 is adhered to exterior surface 304 of back end panel 310. Alternatively, exterior surface 304 of glue flap 318 is adhered to interior surface 302 of back end panel 310. Further, although adhesive is described herein, glue flap 318 can be coupled to back end panel 310 using any suitable fastener and/or technique. Once glue flap 318 is coupled to back end panel 310, back end panel 310 and glue flap 318 form a back end wall 402, second side panel 314 forms a second side wall 404, front end panel 312 forms a front wall 406, and first top side panel 360 forms first side wall 408 of container 400. From this configuration, partially formed container 400 can be collapsed into a knocked-down flat configuration for shipping and/or storage of container 400.

To continue construction of container 400, first bottom side panel 362 is rotated about fold line 366 toward interior surface 302 of first side panel 316, and second bottom side panel 342 is rotated about fold line 346 toward interior surface 302 of second side panel 314. In the exemplary embodiment, first bottom side panel 362 is substantially perpendicular to first side wall 408, and second bottom side panel 342 is substantially perpendicular to second side wall 404. Front bottom end panel 352 is rotated about fold lines 356 and 358 toward interior surface 302 of front end panel 312, and back bottom end panel 332 is rotated about fold line 336 toward interior surface 302 of back end panel 310. As such, bottom side panels 362 and 342 and bottom end panels 352 and 332 form a bottom wall 410 of container 400, as shown in FIG. 4.

To close container 400, front top end panel 350 is rotated about fold line 354 toward interior surface 302 of front end panel 312, and back top end panel 330 is rotated about fold line 334 toward interior surface 302 of back end panel 310. More specifically, after rotation, front top end panel 350 is substantially perpendicular to front end panel 312 and back top end panel 330 is substantially perpendicular to back end panel 310. First top side panel 360 is rotated about fold line 364 toward interior surface 302 of first side panel 316, and second top side panel 340 is rotated about fold line 344 toward interior surface 302 of second side panel 314. More specifically, after rotation, first top side panel 360 is substantially perpendicular to first side panel 316 and second top side panel 340 is substantially perpendicular to second side panel 314. In the exemplary embodiment, top side panels 360 and 340 overlap when top side panels 360 and 340 are substantially parallel to bottom wall 410. Alternatively, top side panels 360 and 340 are sized such that top side panels 360 and 340 do not overlap when top side panels 360 and 340 are substantially parallel to bottom wall 410. In the exemplary embodiment, top side panels 360 and 340 rest on top end panels 350 and 330 while at least top side panels 360 and 340 are secured together using, for example, tape. As such, interior surface 302 of top side panels 360 and/or 340 is adjacent to and/or in direct contact with exterior surface 304 of top end panels 350 and 330. Top side panels 360 and 340 and top end panels 350 and 330 define top wall 412 of container 400.

Once container 400 has been erected, filled and sealed, upon arrival at its destination, container 400 may be opened as follows: an operator grasps front wall 406 by placing their hand under lip 370, pushing up access gap 371, gripping upper portion 420 of container 400 and pulling upwardly against lip 370. Preferably, perforation lines 386, 380, 384, 378, 374, 392 and 338 are created in such a manner that all will yield in a simultaneous manner, so that upon a continuous upward pulling motion, the operator separates and removes upper portion 420 of container 400 from a lower portion 422 of container 400.

Figure 5:
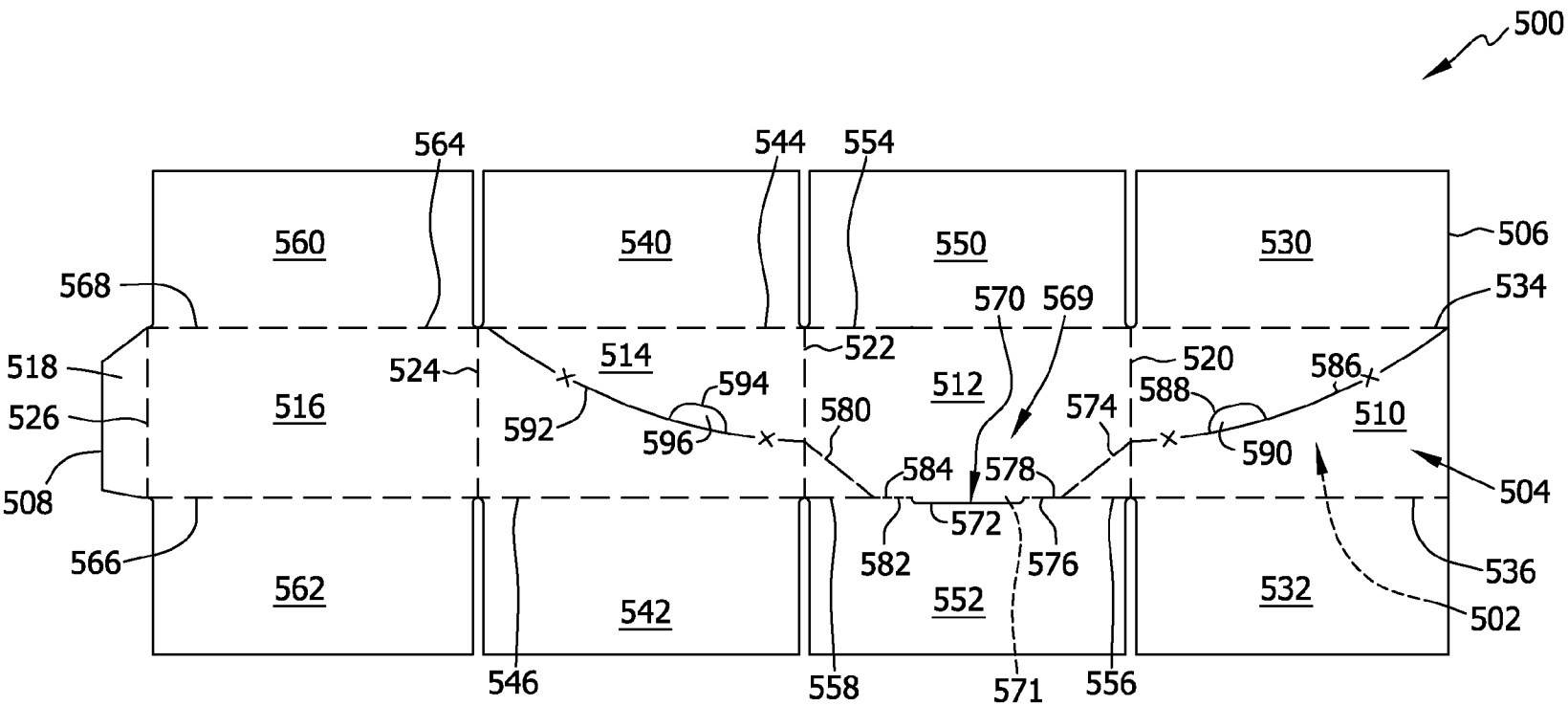
FIG. 5 is top plan schematic illustration of a blank of sheet material of a second alternate exemplary embodiment.
Figure 6:
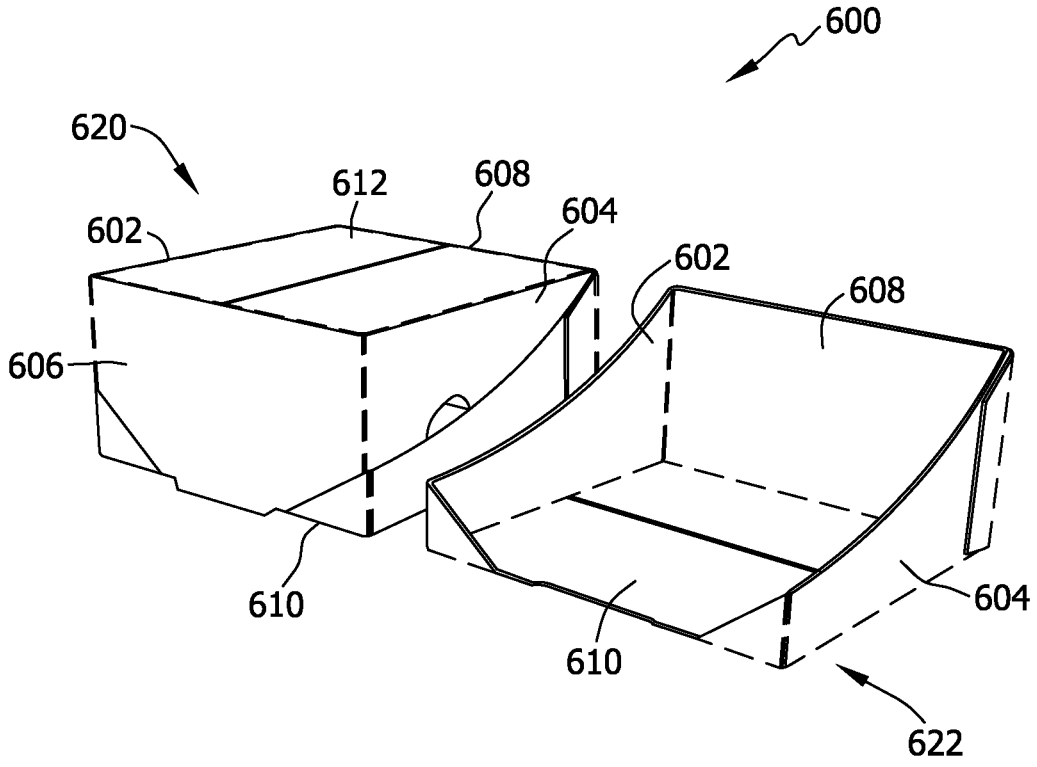
FIG. 6 is a perspective schematic illustration of a container formed from the blank shown in FIG. 5, and the container converted to a display container.

FIGS. 5 and 6 illustrate a blank, and a container made from a blank, according to a second alternative exemplary embodiment of a container. Referring to FIG. 5, blank 500 has a first or interior surface 502 and an opposing second or exterior surface 504. Further, blank 500 defines a leading edge 506 and an opposing trailing edge 508. In one embodiment, blank 500 includes, from leading edge 506 to trailing edge 508, a first side panel 510, a front end panel 512, a second side panel 514, a back end panel 516, and a glue flap 518 coupled together along preformed, generally parallel, fold lines 520, 522, 524, and 526, respectively. More specifically, first side panel 510 extends from front end panel 512 along fold line 520, second side panel 514 extends from front end panel 512 along fold line 522, back end panel 516 extends from second side panel 514 along fold line 524, and glue flap 518 extends from back end panel 516 along fold line 526. Fold lines 520, 522, 524, and/or 526, as well as other fold lines and/or hinge lines described herein, may include any suitable line of weakening and/or line of separation known to those skilled in the art and guided by the teachings herein provided.

First side panel 510 includes a first top side panel 530 and a first bottom side panel 532 extending therefrom along respective fold lines 534 and 536. More specifically, first top side panel 530 extends from first side panel 510 along fold line 534, and first bottom side panel 532 extends from first side panel 510 along fold line 536. Similarly, second side panel 514 includes a second top side panel 540 and a second bottom side panel 542 extending therefrom along respective fold lines 544 and 546. More specifically, second top side panel 540 extends from second side panel 514 along fold line 544, and second bottom side panel 542 extends from second side panel 514 along fold line 546.

Front end panel 512 includes a front top end panel 550 and a front bottom end panel 552 extending therefrom along respective fold lines 554, 556 and 558. More specifically, front top end panel 550 extends from front end panel 512 along fold line 554, and front bottom end panel 552 extends from front end panel 512 along fold lines 556 and 558. Similarly, back end panel 516 includes a back top end panel 560 and a back bottom end panel 562 extending therefrom along respective fold lines 564 and 566. More specifically, back top end panel 560 extends from back end panel 516 along fold line 564, and back bottom end panel 562 extends from back end panel 516 along fold line 566. Fold line 564 includes a perforation/cut line 568.

An opening assembly 569 includes a lip 570 extending from the bottom of front end panel 512 between fold lines 556 and 558. Cut line 572 defines opening lip 570, and creates access gap 571, upon articulation of blank 500 into an erected container. As discussed with respect to the embodiment of FIGS. 1 and 2, opening lip 570 preferably extends into front bottom end panel a length equal or greater to the thickness of blank 500, so as to extend beyond the bottom of the erected container.

A perforation line 574 extends diagonally from fold line 556 to fold line 520. Fold line 556 includes a portion 576 that includes a perforation/cut line 578. Portion 576 of fold line 556 extends from opening lip 570 to perforation line 574. Similarly, a perforation line 580 extends diagonally from fold line 558 to fold line 522. Fold line 558 includes a portion 582 that includes a perforation/cut line 584. Portion 582 of fold line 558 extends from opening lip 570 to perforation line 580.

First side panel 510 includes a perforation line 586 that extends from the intersection of perforation line 574 and fold line 520 to the junction of fold line 534 and leading edge 506. In another embodiment, perforation line 586 extends from the intersection of perforation line 574 and fold line 520 to another location along leading edge 506. Perforation line 586 includes a cut out 588 that defines an access opening 590 in first side panel 510. Cut out 588 is positioned on the upper side of perforation line 586.

Similarly, second side panel 514 includes a perforation line 592 that extends from the intersection of perforation line 580 and fold line 522 to the junction of fold line 544 and fold line 524. In other embodiment, perforation line 592 extends from the intersection of perforation line 580 and fold line 522 to another location along fold line 524. Perforation line 592 includes a cut out 594 that defines an access opening 596 in second side panel 514. Cut out 594 is positioned on the upper side of perforation line 592.

In addition, the exemplary embodiment may include a cut-out, score lines, or perforation lines on front bottom end panel 552 to facilitate a user to insert fingers within access gap 571 for pulling on opening lip 570.

Referring to FIG. 6, to construct container 600 from blank 500, first side panel 510 is rotated about fold line 520 toward interior surface 502 of front end panel 512, front end panel 512 is rotated about fold line 522 toward interior surface 502 of second side panel 514, second side panel 514 is rotated about fold line 524 toward interior surface 502 of back end panel 516, and glue flap 518 is rotated about fold line 526 toward interior surface 502 of back end panel 516. In the exemplary embodiment, after rotating panels 510, 512, 514, and 516 and glue flap 518 about fold lines 520, 522, 524, and 526, side panels 510 and 514 are substantially parallel to each other and substantially perpendicular to end panels 512 and 516. Panels 510, 512, 514, and 516 and glue flap 518 can be rotated about fold lines 520, 522, 524, and 526 by wrapping blank 500 about a mandrel within a machine or by using a tray folder machine. Alternatively, a folder/glue machine can be used to convey blank 500 through folder arms and an adhesive applicator to form a knocked-down flat container.

Once panels 510, 512, 514, and 516 and glue flap 518 are rotated about fold lines 520, 522, 524, and 526, glue flap 518 is coupled to first side panel 510. For example, in the exemplary embodiment, interior surface 502 of glue flap 518 is adhered to exterior surface 504 of first side panel 510. Alternatively, exterior surface 504 of glue flap 518 is adhered to interior surface 502 of first side panel 510. Further, although adhesive is described herein, glue flap 518 can be coupled to first side panel 510 using any suitable fastener and/or technique. Once glue flap 518 is coupled to first side panel 510, first side panel 510 and glue flap 518 form a first side wall 602, second side panel 514 forms a second side wall 604, front end panel 512 forms a front wall 606, and back end panel 560 forms back end wall 608 of container 600. From this configuration, partially formed container 600 can be collapsed into a knocked-down flat configuration for shipping and/or storage of container 600.

To continue construction of container 600, first bottom side panel 532 is rotated about fold line 536 toward interior surface 502 of first side panel 510, and second bottom side panel 542 is rotated about fold line 546 toward interior surface 502 of second side panel 514. In the exemplary embodiment, first bottom side panel 532 is substantially perpendicular to first side wall 602, and second bottom side panel 542 is substantially perpendicular to second side wall 604. Front bottom end panel 552 is rotated about fold lines 556 and 558 toward interior surface 502 of front end panel 512, and back bottom end panel 562 is rotated about fold line 566 toward interior surface 502 of back end panel 516. As such, bottom side panels 532 and 542 and bottom end panels 552 and 562 form a bottom wall 610 of container 600, as shown in FIG. 6.

To close container 600, front top end panel 550 is rotated about fold line 554 toward interior surface 502 of front end panel 512, and back top end panel 560 is rotated about fold line 564 toward interior surface 502 of back end panel 516. More specifically, after rotation, front top end panel 550 is substantially perpendicular to front end panel 512 and back top end panel 560 is substantially perpendicular to back end panel 516. First top side panel 530 is rotated about fold line 534 toward interior surface 502 of first side panel 510, and second top side panel 540 is rotated about fold line 544 toward interior surface 502 of second side panel 514. More specifically, after rotation, first top side panel 530 is substantially perpendicular to first side panel 510 and second top side panel 540 is substantially perpendicular to second side panel 514. In the exemplary embodiment, top side panels 530 and 540 overlap when top side panels 530 and 540 are substantially parallel to bottom wall 606. Alternatively, top side panels 530 and 540 are sized such that top side panels 530 and 540 do not overlap when top side panels 530 and 540 are substantially parallel to bottom wall 610. In the exemplary embodiment, top side panels 530 and 540 rest on top end panels 550 and 560 while at least top side panels 530 and 540 are secured together using, for example, tape. As such, interior surface 502 of top side panels 530 and/or 540 is adjacent to and/or in direct contact with exterior surface 504 of top end panels 550 and 560. Top side panels 530 and 540 and top end panels 550 and 560 define top wall 612 of container 600.

Once container 600 has been erected, filled and sealed, upon arrival at its destination, container 600 may be opened as follows: an operator grasps front wall 606 by placing their hand within access gap 571, gripping upper portion 620 of container 400 and pulling upwardly against lip 570. Preferably, perforation lines 586, 580, 584, 578, 574, 592 and 568 are created in such a manner that all will yield in a simultaneous manner, so that upon a continuous upward pulling motion, the operator separates and removes upper portion 620 of container 600 from a lower portion 622 of container 600.

Figure 7:
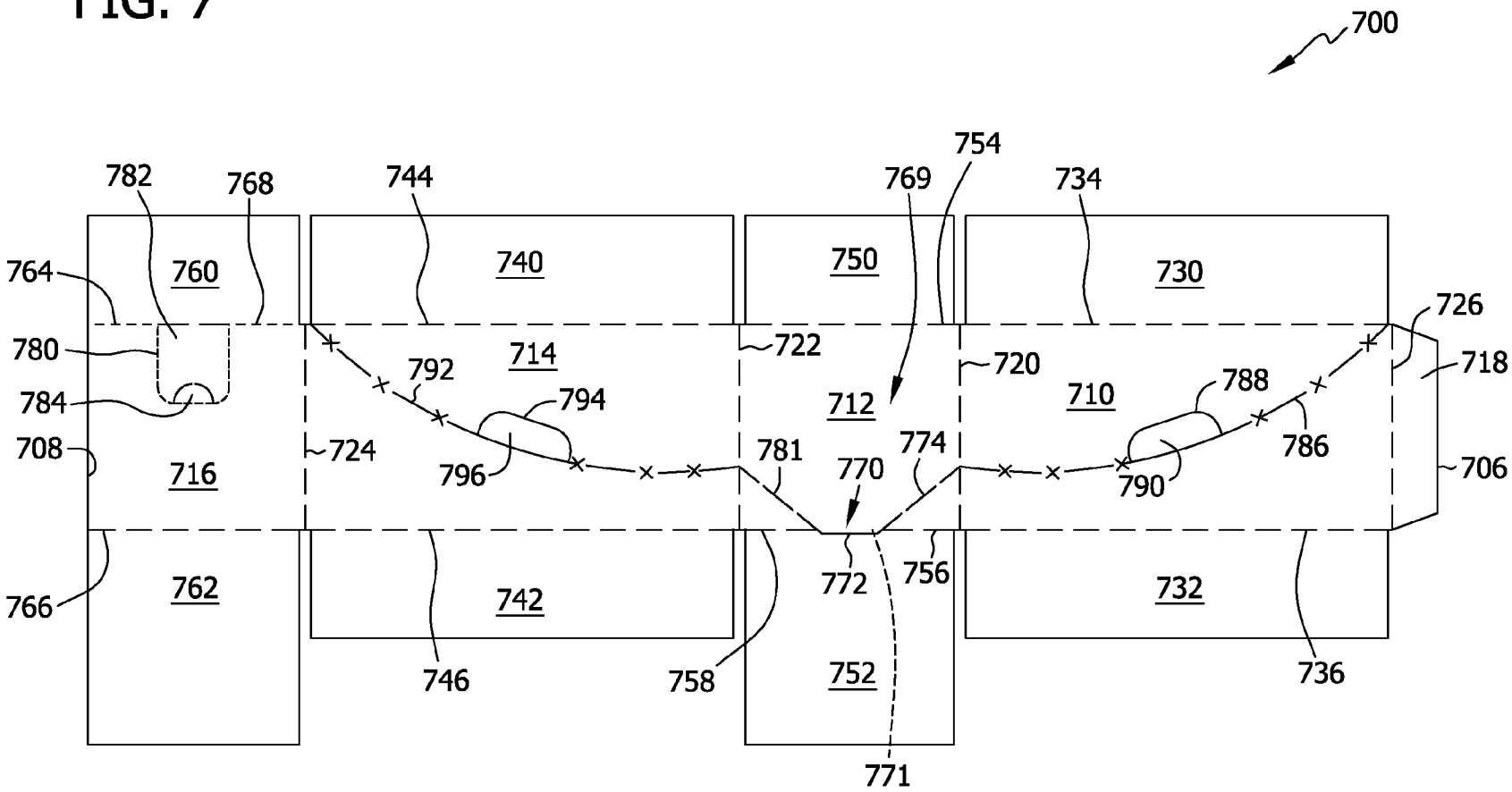
FIG. 7 is top plan schematic illustration of a blank of sheet material of a third alternate embodiment.
Figure 8:
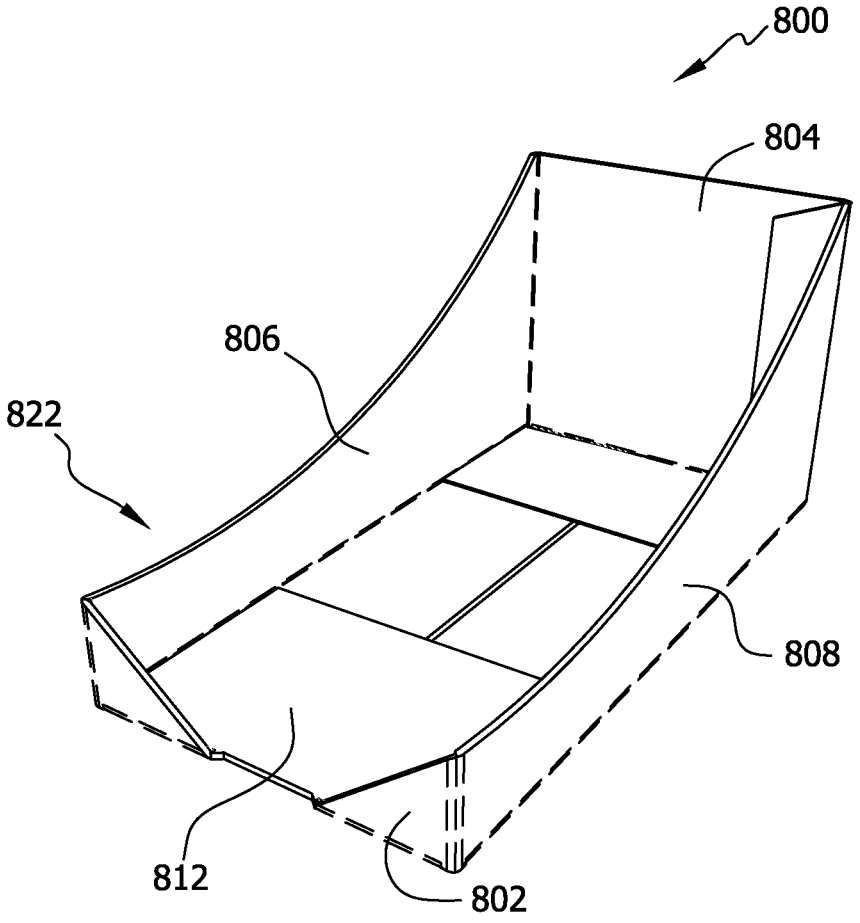
FIG. 8 is a perspective schematic illustration of a container formed from the blank shown in FIG. 7.
Figure 9:
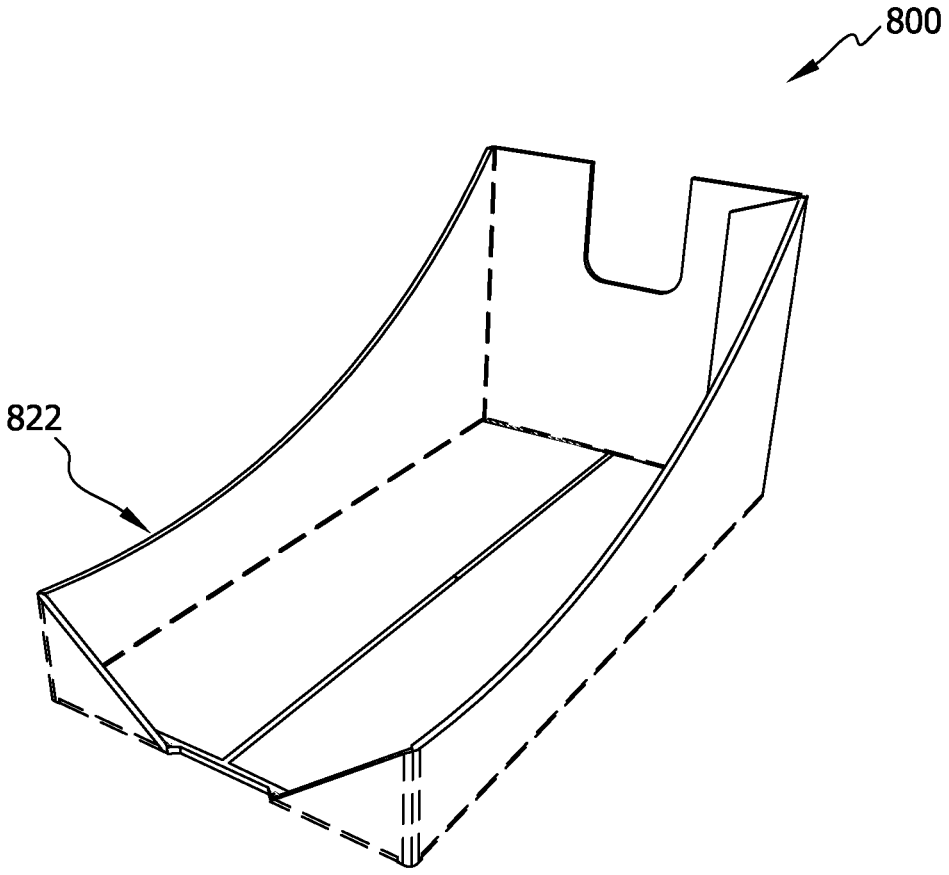
FIG. 9 is a perspective schematic illustration of the container shown in FIG. 8 that has been converted to a display container.

FIG. 7 is a top plan view a third alternative blank 700 of sheet material. FIG. 8 is a top perspective view of a container 800 formed from blank 700, and FIG. 9 is a top perspective view of container 800 converted to a display container.

Referring to FIG. 7, blank 700 includes, from leading edge 706 to trailing edge 708, a glue flap 718, a first side panel 710, a front end panel 712, a second side panel 714, and a back end panel 716 coupled together along preformed, generally parallel, fold lines 726, 720, 722, and 724, respectively. More specifically, glue flap extends from first side panel 710 along fold line 726, front end panel 712 extends from first side panel 710 along fold line 720, second side panel 714 extends from front end panel 712 along fold line 722, and back end panel 716 extends from second side panel 714 along fold line 724. Fold lines 720, 722, 724, and/or 726, as well as other fold lines and/or hinge lines described herein, may include any suitable line of weakening and/or line of separation known to those skilled in the art and guided by the teachings herein provided.

Front end panel 712 includes a front top end panel 750 and a front bottom end panel 752 extending therefrom along respective fold lines 754, 756 and 758. More specifically, front top end panel 750 extends from front end panel 712 along fold line 754, and front bottom end panel 752 extends from front end panel 712 along fold lines 756 and 758. First side panel 710 includes first side top panel 730 and first side bottom panel 732 extending along fold lines 734 and 736, respectively. Second side panel 714 includes second side top panel 740 and second side bottom panel 742, extending along fold lines 744 and 746, respectively. Similarly, back end panel 716 includes a back top end panel 760 and a back bottom end panel 762 extending therefrom along respective fold lines 764 and 766. More specifically, back top end panel 760 extends from back end panel 716 along fold line 764, and back bottom end panel 762 extends back from back end panel 716 along fold line 766. Fold line 764 includes a perforation/cut line 768. Back end panel 716 includes a cut line 780 extending from fold line 764 defining a tab 782 that may be removed from back end panel 716. Tab 782 includes knock-out 784 that permits a user to insert a finger into the knock-out 784 to grab and remove tab 782 from back end panel 716.

Blank 700 further includes perforations 786, 774, 781, and 792, as well as cut lines 788 and 794, which define access openings 790 and 796. An opening assembly 769 includes an opening lip 770 extending from the bottom of front end panel 712 between fold lines 756 and 758, and access opening 771, created upon articulation of blank 700 into erected container 800. As discussed with respect to the embodiment of FIGS. 1 and 2, opening lip 770 preferably extends into front bottom end panel a length equal or greater to the thickness of blank 700, so as to extend beyond the bottom of the erected container. Perforation line 772 enables access tab 782 to be pushed in or removed entirely to permit an operator to reach opening lip 770.

Container 800, shown in FIGS. 8 and 9, may be erected, filled, and subsequently opened, using steps identical, similar or analogous to those described with respect to container 200 of the embodiment of FIGS. 1 and 2, container 400 of the embodiment of FIGS. 3 and 4, or container 600 of the embodiment of FIGS. 5 and 6. Specifically, upon articulation and gluing of blank 700, container 800 will have front wall 802, at the bottom of which is opening lip 770, as well as back wall 804, first side wall 806, second side wall 808, and bottom wall 812. To open container 800, an operator grips opening lip 770 and pulls upwardly, separating upper portion (not shown) from lower portion 822 (shown in FIG. 9).

Figure 10:
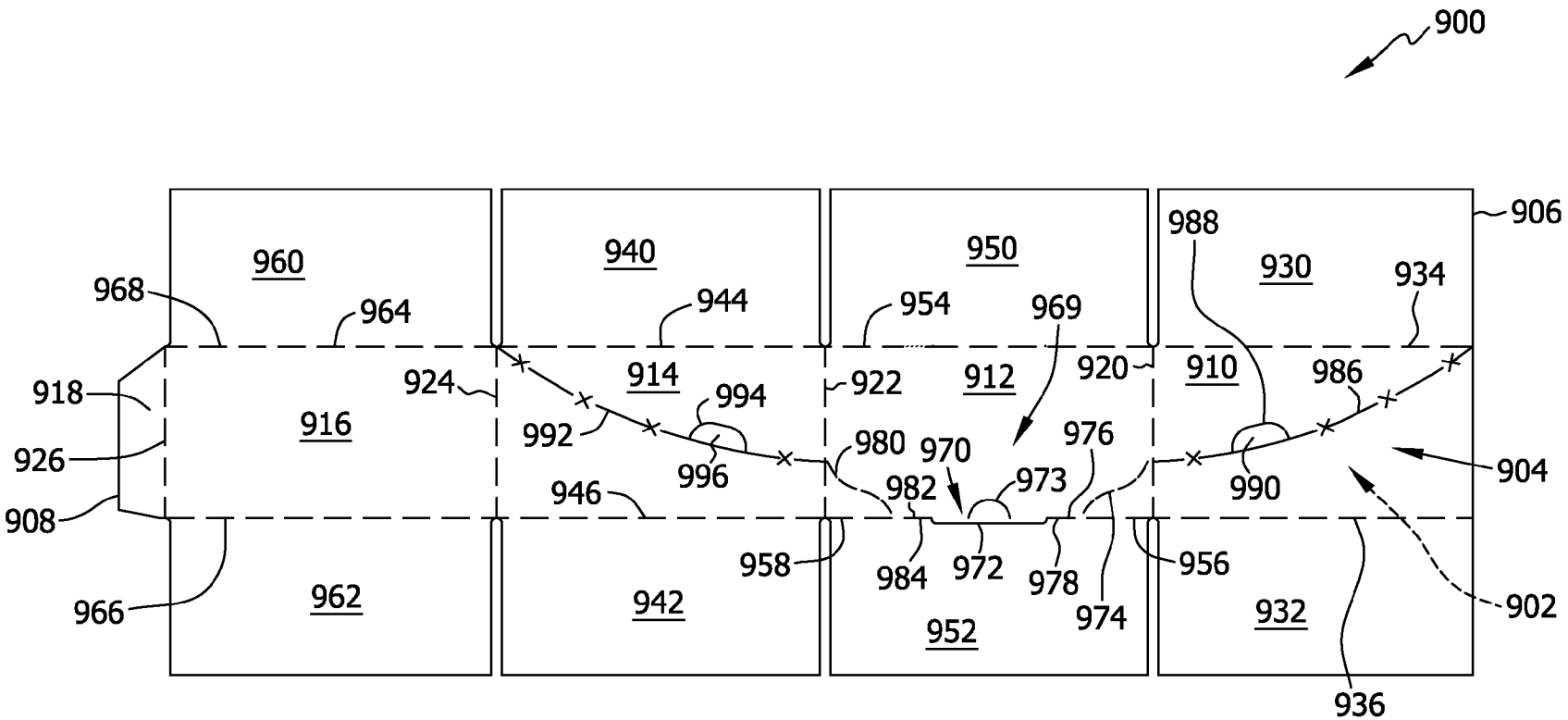
FIG. 10 is top plan schematic illustration of a blank of sheet material of a fourth alternate embodiment.

FIG. 10 is a top plan view a fourth alternative blank 900 that is similar to blank 700 shown in FIG. 7. Referring to FIG. 10, blank 900 has a first or interior surface 902 and an opposing second or exterior surface 904. Further, blank 900 defines a leading edge 906 and an opposing trailing edge 908. In one embodiment, blank 900 includes, from leading edge 906 to trailing edge 908, a first side panel 910, a front end panel 912, a second side panel 914, a back end panel 916, and a glue flap 918 coupled together along preformed, generally parallel, fold lines 920, 922, 924, and 926, respectively. More specifically, first side panel 910 extends from front end panel 912 along fold line 920, second side panel 914 extends from front end panel 912 along fold line 922, back end panel 916 extends from second side panel 914 along fold line 924, and glue flap 918 extends from back end panel 916 along fold line 926. Fold lines 920, 922, 924, and/or 926, as well as other fold lines and/or hinge lines described herein, may include any suitable line of weakening and/or line of separation known to those skilled in the art and guided by the teachings herein provided.

First side panel 910 includes a first top side panel 930 and a first bottom side panel 932 extending therefrom along respective fold lines 934 and 936. More specifically, first top side panel 930 extends from first side panel 910 along fold line 934, and first bottom side panel 932 extends from first side panel 910 along fold line 936. Similarly, second side panel 914 includes a second top side panel 940 and a second bottom side panel 942 extending therefrom along respective fold lines 944 and 946. More specifically, second top side panel 940 extends from second side panel 914 along fold line 944, and second bottom side panel 942 extends from second side panel 914 along fold line 946.

Front end panel 912 includes a front top end panel 950 and a front bottom end panel 952 extending therefrom along respective fold lines 954, 956 and 958. More specifically, front top end panel 950 extends from front end panel 912 along fold line 954, and front bottom end panel 952 extends from front end panel 912 along fold lines 956 and 958. Similarly, back end panel 916 includes a back top end panel 960 and a back bottom end panel 962 extending therefrom along respective fold lines 964 and 966. More specifically, back top end panel 960 extends from back end panel 916 along fold line 964, and back bottom end panel 962 extends from back end panel 916 along fold line 966. Fold line 964 includes a perforation/cut line 968.

An opening assembly 969 includes a lip 970 extending from the bottom of front end panel 912 between fold lines 956 and 958. Cut line 972 defines opening lip 970. As discussed with respect to the embodiment of FIGS. 1 and 2, opening lip 970 preferably extends into front bottom end panel a length equal or greater to the thickness of blank 900, so as to extend beyond the bottom of the erected container.

A perforation line 974 extends diagonally from fold line 956 to fold line 920. Fold line 956 includes a portion 976 that includes a perforation/cut line 978. Portion 976 of fold line 956 extends from opening lip 970 to perforation line 974. Similarly, a perforation line 980 extends diagonally from fold line 958 to fold line 922. Fold line 958 includes a portion 982 that includes a perforation/cut line 984. Portion 982 of fold line 958 extends from opening lip 970 to perforation line 980. Blank 900 further includes crush tab 973, in which the material of blank 900 has been crushed, e.g., along an arcuate line, through which a finger or thumb may be pushed.

First side panel 910 includes a perforation line 986 that extends from the intersection of perforation line 974 and fold line 920 to the junction of fold line 934 and leading edge 906. In another embodiment, perforation line 986 extends from the intersection of perforation line 974 and fold line 920 to another location along leading edge 906. Perforation line 986 includes a cut out 988 that defines an access opening 990 in first side panel 910. Cut out 988 is positioned on the upper side of perforation line 986.

Similarly, second side panel 914 includes a perforation line 992 that extends from the intersection of perforation line 980 and fold line 922 to the junction of fold line 944 and fold line 924. In other embodiment, perforation line 992 extends from the intersection of perforation line 980 and fold line 922 to another location along fold line 924. Perforation line 992 includes a cut out 994 that defines an access opening 996 in second side panel 914. Cut out 994 is positioned on the upper side of perforation line 992.

Figure 11:
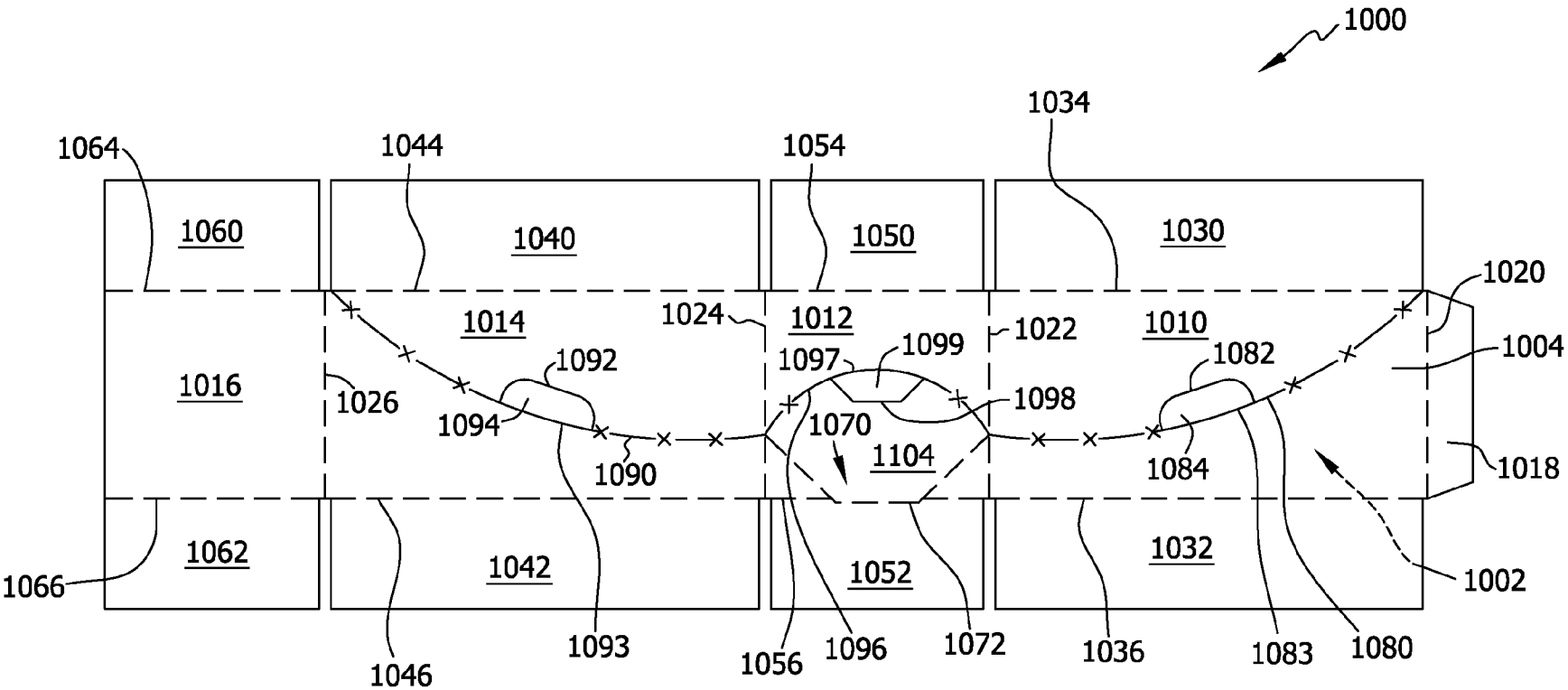
FIG. 11 is top plan schematic illustration of a blank of sheet material of a fifth alternate embodiment.
Figure 12:
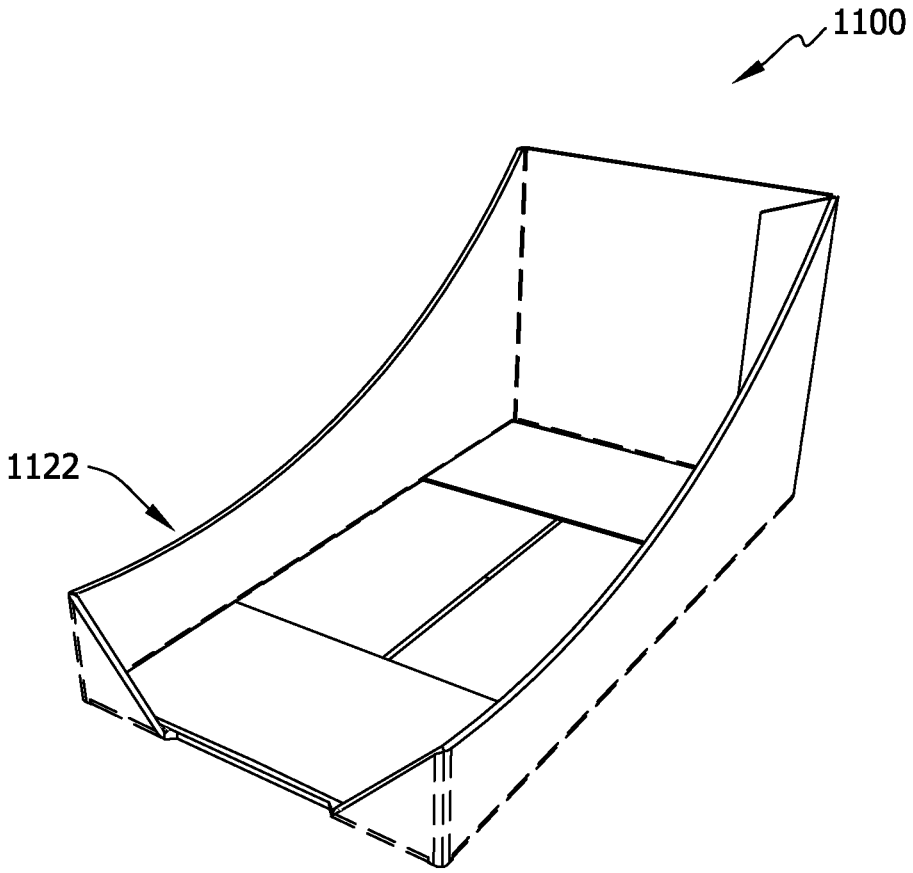
FIG. 12 is a perspective schematic illustration of a container formed from the blank shown in FIG. 11 that has been converted to a display container.

FIG. 11 is a top plan schematic illustration of a blank 1000 of sheet material of a fifth alternative embodiment, and FIG. 12 is a perspective schematic illustration of a container 1100 formed from blank 1000, and that has been converted to a display container. Blank 1000 include interior side 1002 and exterior side 1004, and further includes glue flap 1018, first side panel 1010, front end panel 1012, second side panel 1014 and rear end panel 1016, as well as fold lines 1020, 1022, 1024, and 1026. Blank further includes first top side panel 1030, first bottom side panel 1032, front top end panel 1050, front bottom end panel 1052, second top side panel 1040, second bottom side panel 1042, back top end panel 1060, and back bottom end panel 1062, as well as fold lines 1034, 1036, 1054, 1056, 1044, 1046, 1064 and 1066. Blank 1000 still further includes perforations 1072 (which defines opening lip 1070), 1080, 1090, 1096, and cut lines 1082 and 1083 (which define access opening 1084), 1092 and 1093 (which define access opening 1094), and 1097 and 1098 (which define access opening 1099). As discussed with respect to the embodiment of FIGS. 1 and 2, opening lip 1070 preferably extends into front bottom end panel a length equal or greater to the thickness of blank 1000, so as to extend beyond the bottom of the erected container.

Articulation and gluing of blank 1000, in a manner similar to that used with respect to the blank of the embodiment of FIG. 5, results in container 1100, the lower portion 1122 of which is shown in FIG. 12. Container 1100 is opened, by removal of a top portion (not shown), via insertion of a hand or implement into access opening 1099, and pulling away of panel 1104 (FIG. 11), and subsequently lifting up the top portion, tearing it away along the several lines of perforations previously described.

Figure 13:
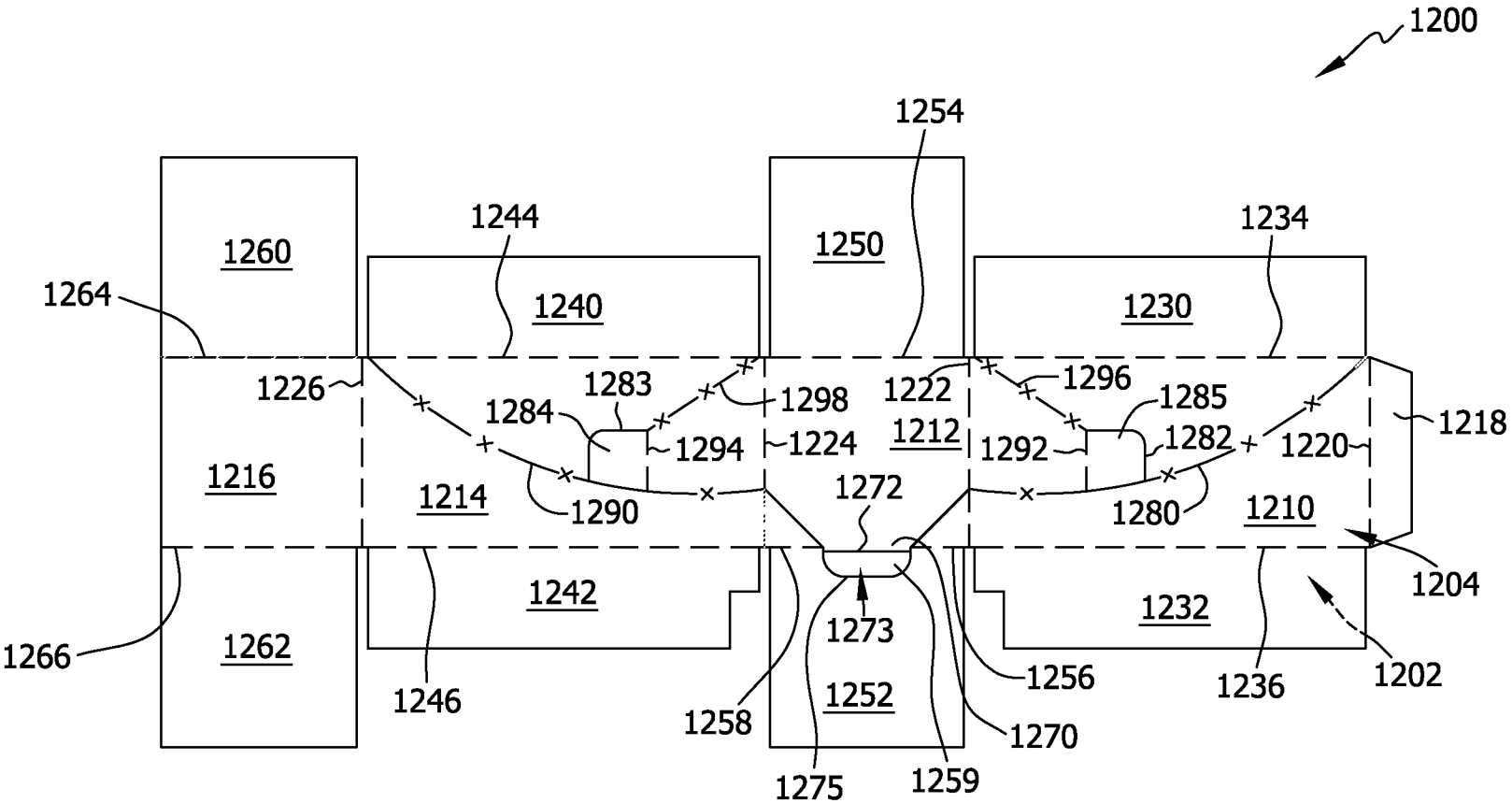
FIG. 13 is top plan schematic illustration of a blank of sheet material of a sixth alternate embodiment.
Figure 14:
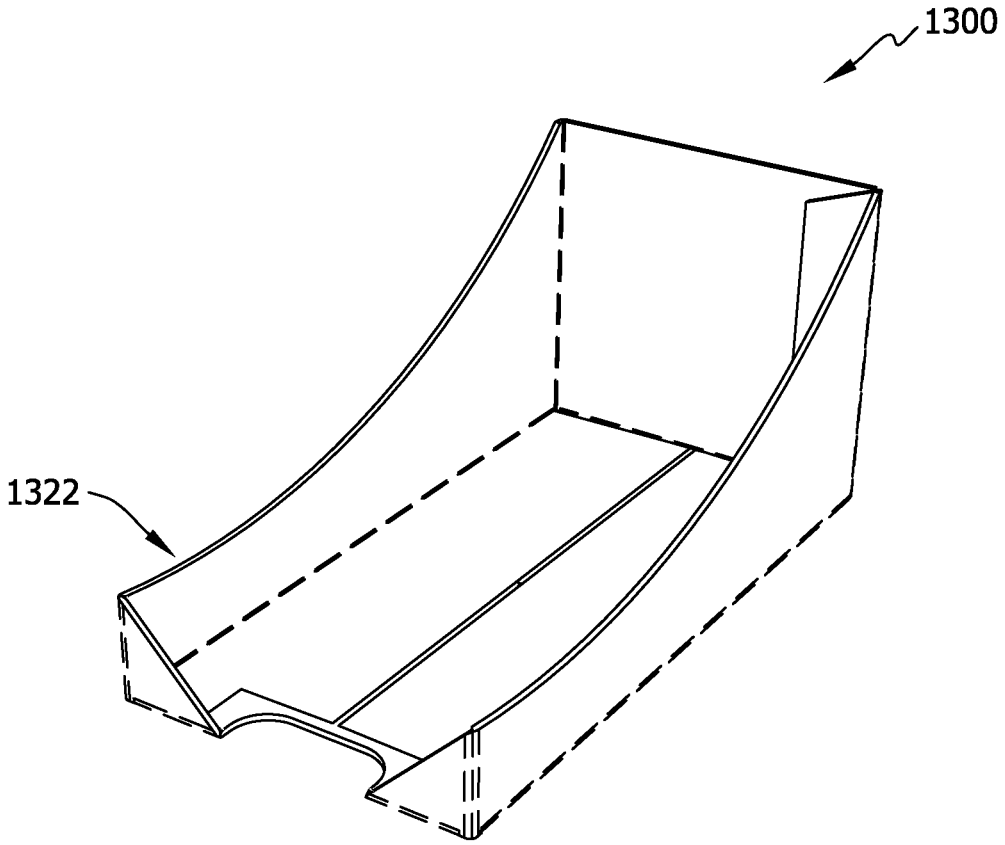
FIG. 14 is a perspective schematic illustration of a container formed from the blank shown in FIG. 13 that has been converted to a display.

FIG. 13 is top plan schematic illustration of a blank 1200 of sheet material of a sixth alternate embodiment, and FIG. 14 is a perspective schematic illustration of a container 1300 formed from blank 1200, and that has been converted to a display container.

Blank 1200 includes interior side 1202 and exterior side 1204, and further includes glue flap 1218, first side panel 1210, front end panel 1212, second side panel 1214 and rear end panel 1216, as well as fold lines 1220, 1222, 1224, and 1226. Blank further includes first top side panel 1230, first bottom side panel 1232, front top end panel 1250, front bottom end panel 1252, second top side panel 1240, second bottom side panel 1242, back top end panel 1260, and back bottom end panel 1262, as well as fold lines 1234, 1236, 1254, 1256, 1258, 1244, 1246, 1264 and 1266. Blank 1200 still further includes cut line 1272 (which defines opening lip 1270), cut line 1273 (which with cut line 1272 defines access opening 1275), as well as perforations 1280, 1290, 1292, 1294, 1296, and 1298, and cut lines 1282 and 1283 (which define push-in access flaps 1284 and 1285). As discussed with respect to the embodiment of FIGS. 1 and 2, opening lip 1270 preferably extends into front bottom end panel a length equal or greater to the thickness of blank 1200, so as to extend beyond the bottom of the erected container.

Articulation and gluing of blank 1200, in a manner similar to that of the embodiment of FIG. 5, results in container 1300, the lower portion 1322 of which is shown in FIG. 14. Container 1300 is opened, by removal of a top portion (not shown), via insertion of a hand or implement into access opening 1259, and pulling up on front end panel 1212 (FIG. 13), and subsequently lifting up the top portion, tearing it away along the several lines of perforations previously described.

Figure 15:
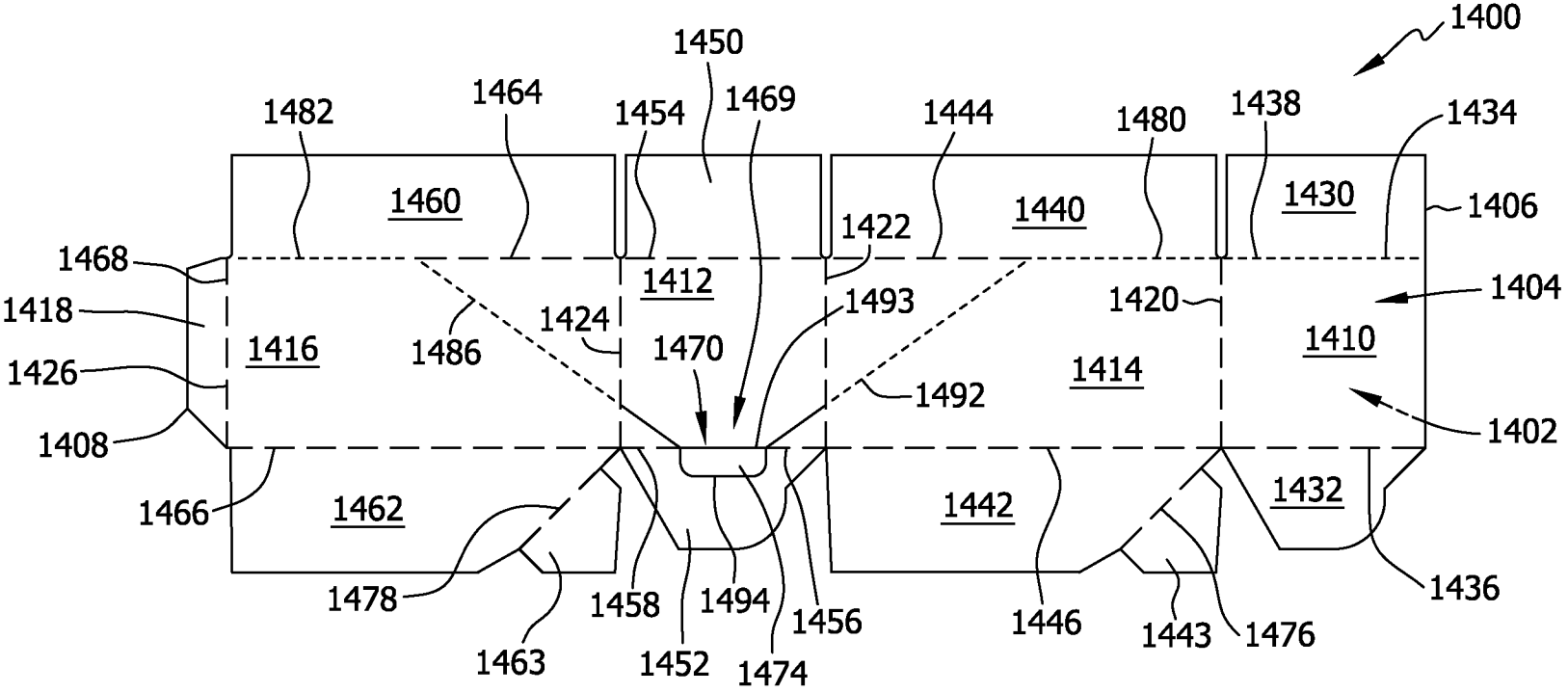
FIG. 15 is top plan schematic illustration of a blank of sheet material of a seventh alternate embodiment.
Figure 16:
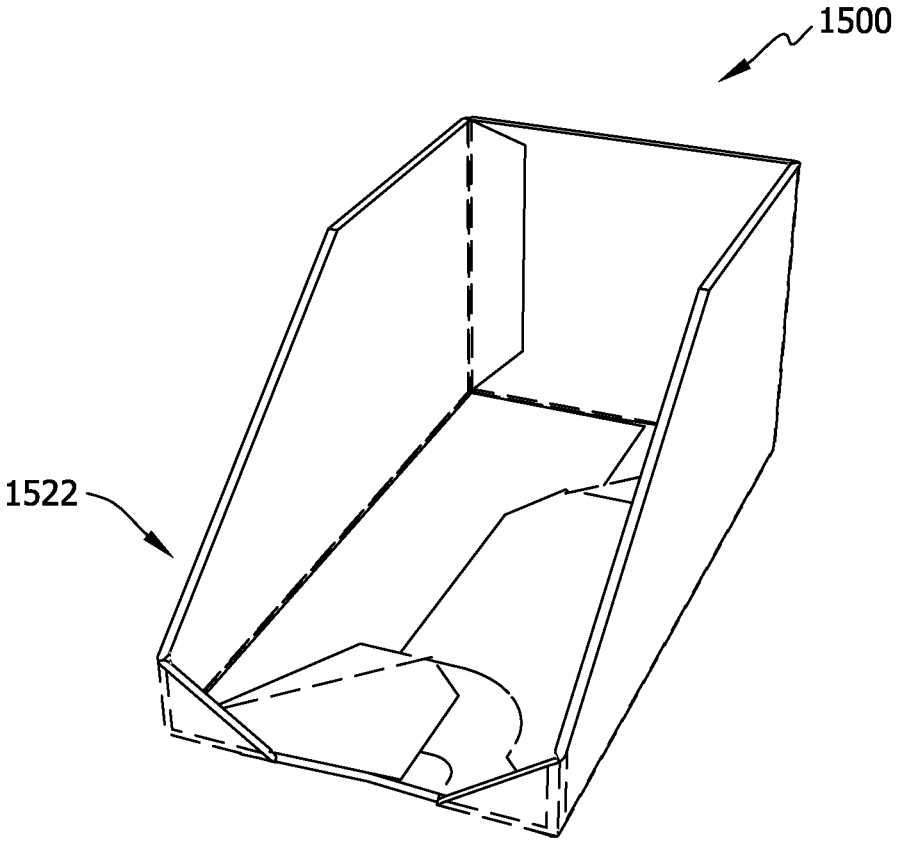
FIG. 16 is a perspective schematic illustration of a container formed from the blank shown in FIG. 12 that has been converted to a display.

FIG. 15 is top plan schematic illustration of a blank 1400 of sheet material of an seventh alternate embodiment, and FIG. 16 is a perspective schematic illustration of a container 1500 formed from blank 1400, and that has been converted to a display container. The alternate embodiment of FIGS. 15 and 16 is similar to the exemplary embodiment shown in FIGS. 1 and 2.

Blank 1400 includes interior surface 1402, exterior surface 1404, leading edge 1406 and trailing edge 1408. Blank 1400 also includes back end panel 1410, first side panel 1414, front end panel 1412, second side panel 1416, and glue flap 1418, as well as back top end panel 1430, back bottom end panel 1432, first top side panel 1440, first bottom side panel 1442 (with flap 1443), front top end panel 1450, front bottom end panel 1452, second top side panel 1460 and second bottom side panel 1462 (with flap 1463). Blank 1400 still further includes fold lines 1420, 1422, 1424, 1426, 1434, 1436, 1444, 1446, 1454, 1456, 1458, 1464, 1466, 1468, 1476 and 1478. Blank 1400 also includes perforations 1438 (superimposed over fold line 1434), 1480, 1482, 1486, and 1492, as well as cut lines 1493, 1494, which define access opening 1474. Blank 1400 further includes opening assembly 1469 that includes a lip 1470. As discussed with respect to the embodiment of FIGS. 1 and 2, opening lip 1470 may extend into front bottom end panel a length equal or greater to the thickness of blank 1400, so as to extend beyond, or at least be even with, the bottom of the erected container.

Articulation and gluing of blank 1400, in a manner similar to that of the embodiment of FIG. 1, results in container 1500, the lower portion 1522 of which is shown in FIG. 16. Container 1500 is opened, by removal of a top portion (not shown), via insertion of a hand or implement into access opening 1474, lifting up on opening lip 1470, and subsequently lifting up the top portion, tearing it away along the several lines of perforations previously described. The embodiment of FIGS. 14 and 15 is provided with bottom panels, which, upon gluing, will form an "automatic" bottom, such as would be readily appreciated by one of ordinary skill in the art having the present disclosure before them.

Figure 17:
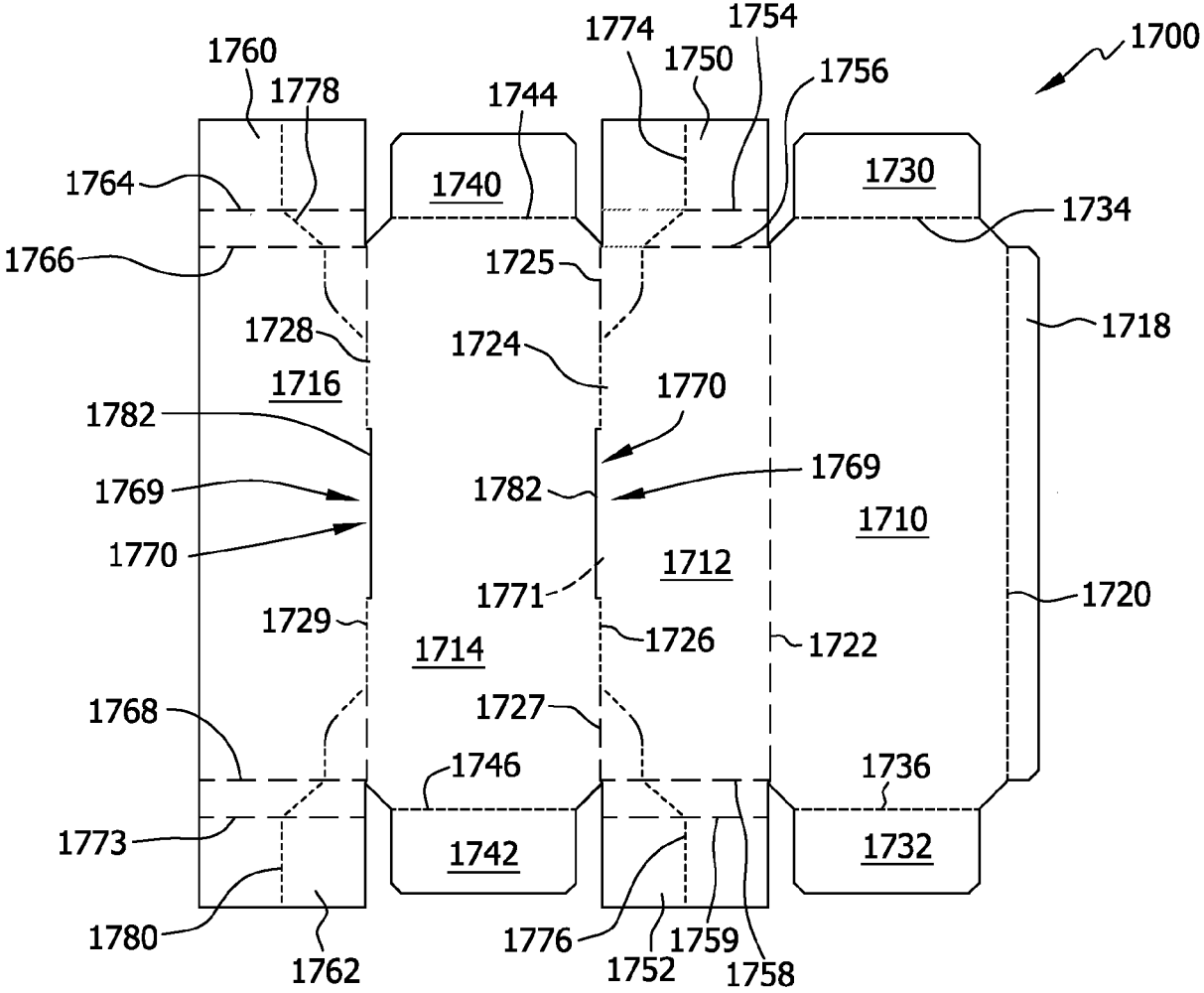
FIG. 17 is top plan schematic illustration of a blank of sheet material of an eighth alternate embodiment.
Figure 18:
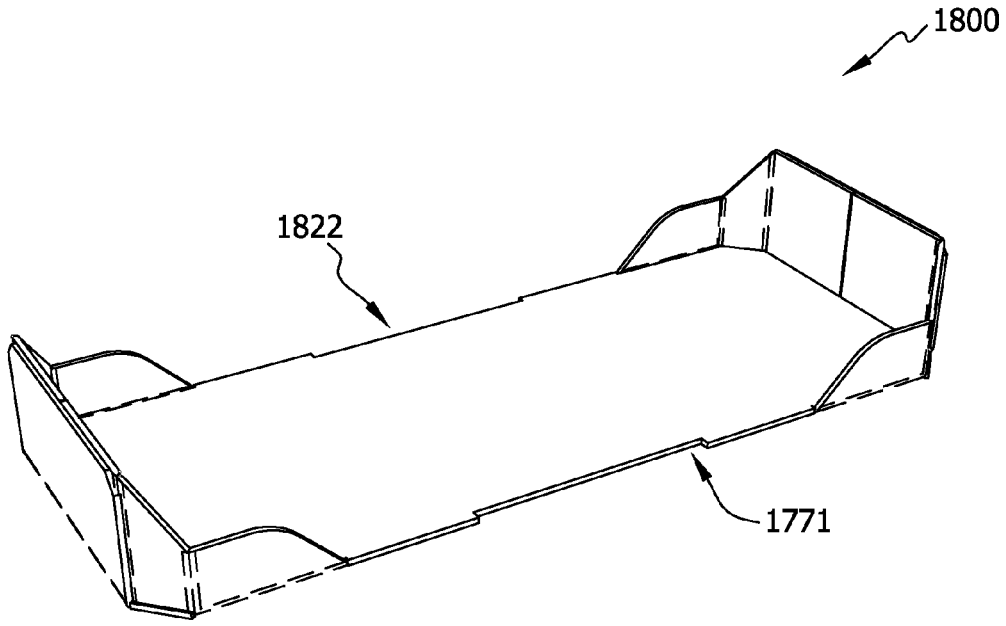
FIG. 18 is a perspective schematic illustration of a container formed from the blank shown in FIG. 17 that has been converted to a display container.

FIG. 17 is top plan schematic illustration of a blank 1700 of sheet material of a eighth alternate embodiment, and FIG. 18 is a perspective schematic illustration of a container 1800 formed from blank 1700, and that has been converted to a display container. The eighth alternate embodiment is similar to the exemplary embodiment shown in FIGS. 1 and 2. Blank 1700 includes glue flap 1718, first side panel 1710, front end panel 1712, second side panel 1714, and back end panel 1716, as well as first top side panel 1730, first bottom side panel 1732, front top end panel 1750, front bottom end panel 1752, second top side panel 1740, second bottom side panel 1742, back top end panel 1760 and back bottom end panel 1762, as well as fold lines 1722, 1725, 1727, 1754, 1756, 1758, 1759, 1764, 1766, 1768, and 1773. In addition, blank 1700 includes perforations 1720, 1734, 1736, 1774, 1724, 1726, 1776, 1744, 1746, 1778, 1728, 1729 and 1780. Blank 1700 includes an opening assembly 1769 that includes opening lip 1770 (defined by cut 1782) on front end panel 1712 and a similar second opening assembly 1769 on back end panel 1716.

Articulation and gluing of blank 1700, in a manner similar to that of the embodiment of FIG. 7, results in container 1800, the lower portion 1822 of which is shown in FIG. 18. As discussed with respect to the embodiment of FIGS. 1 and 2, opening lips 1770 preferably extend into the adjacent panels a length equal or greater to the thickness of blank 1700, so as to extend beyond the bottom of the erected container.

As with the other embodiments, upon articulation of blank 1700, the projection of opening lips 1770 create gaps 1771 (FIG. 18), so that an operator may insert their fingers "behind" opening lips 1770, to enable removal of the upper portion (not shown) of container 1800 by lifting up on opening lips 1770, and subsequently lifting up the top portion, tearing it away along the several lines of perforations previously described.

Figure 19:
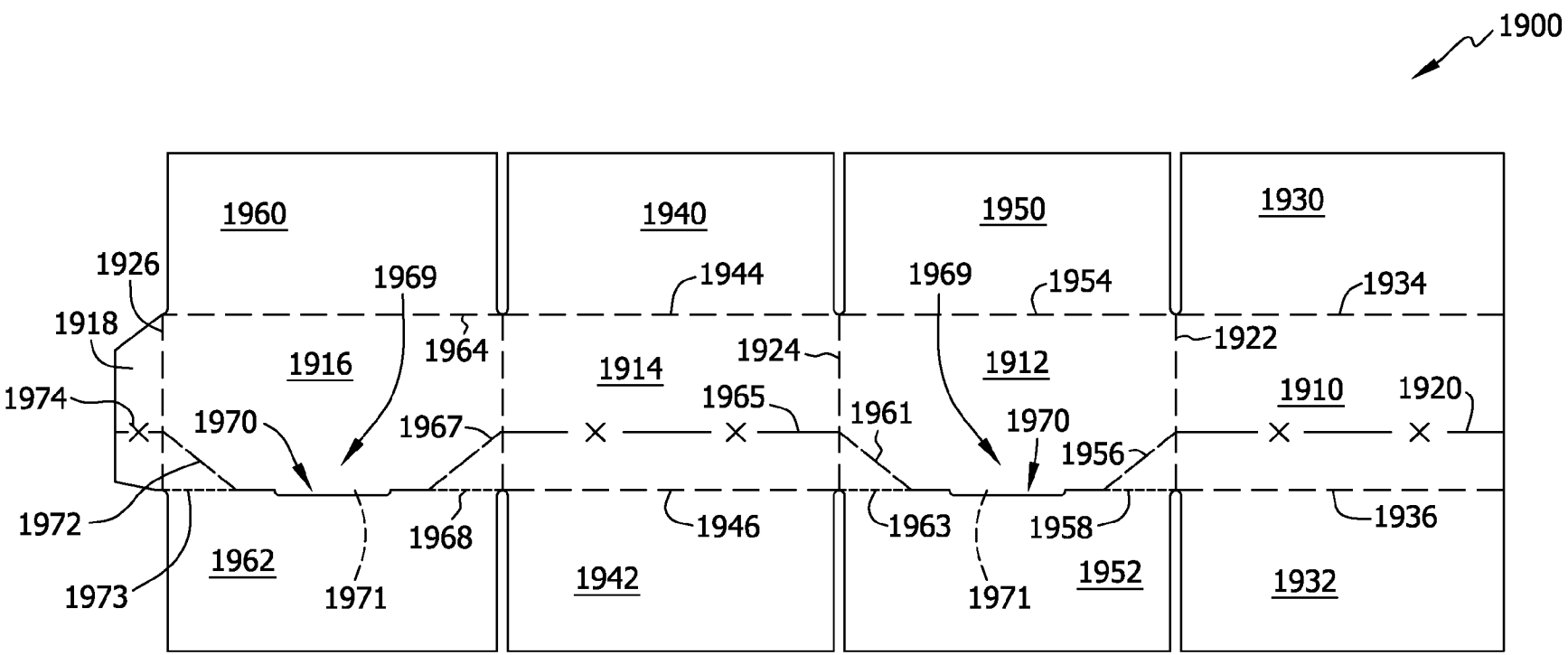
FIG. 19 is top plan schematic illustration of a blank of sheet material of a ninth alternate embodiment.

FIG. 19 is top plan schematic illustration of a blank 1900 of sheet material of a ninth alternate embodiment. The seventh alternate embodiment is similar to the exemplary embodiment shown in FIGS. 1 and 2, as well as the exemplary embodiment of FIGS. 17 and 18. Blank 1900 includes first side panel 1910, front end panel 1912, second side panel 1914 and back end panel 1916, as well as first top side panel 1930, first bottom side panel 1932, front top end panel 1950, front bottom end panel 1952, second top side panel 1940, second bottom side panel 1942, back top end panel 1960, back bottom end panel 1962 and glue flap 1918. Blank 1900 also includes fold lines 1934, 1936, 1922, 1954, 1958, 1963, 1924, 1944, 1946, 1964, 1968, 1973 and 1926, as well as perforations 1920, 1956, 1961, 1965, 1967, 1972, and 1974.

Blank 1900 also includes an opening assembly 1969 that includes opening lip 1970 and access gap 1971 on front end panel 1912 and an opening assembly 1969 with opening lip 1970 and access gap 1971 on back end panel 1916. Articulation and gluing of blank 1900, and the subsequent opening of same, is accomplished in a similar manner to that of the embodiment of FIGS. 17 and 18. As discussed with respect to the embodiment of FIGS. 1 and 2, opening lips 1970 preferably extend into the adjacent panels a length equal or greater to the thickness of blank 1900, so as to extend beyond the bottom of the erected container.

Figure 20:
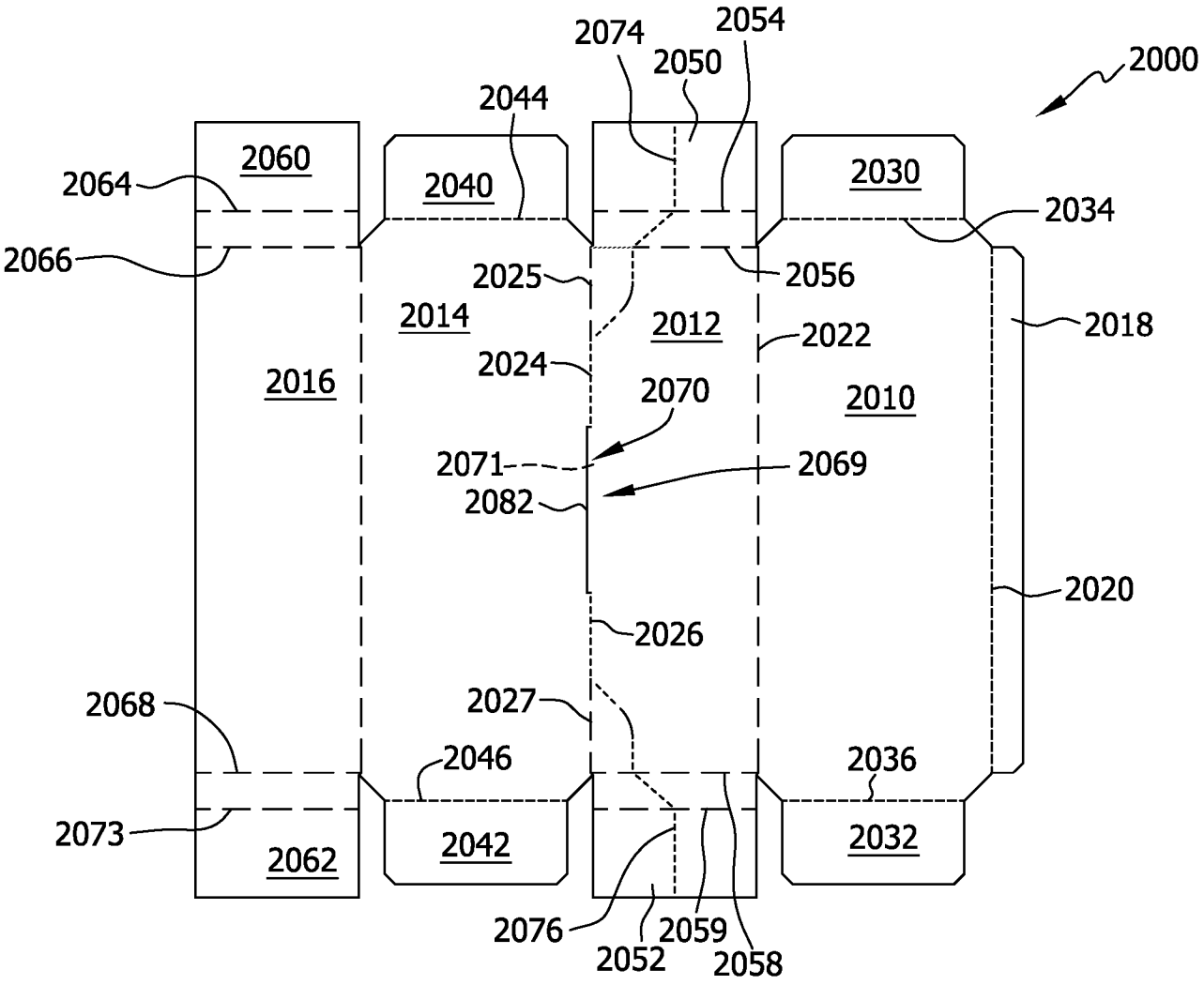
FIG. 20 is top plan schematic illustration of a blank of sheet material of a tenth alternate embodiment.
Figure 21:
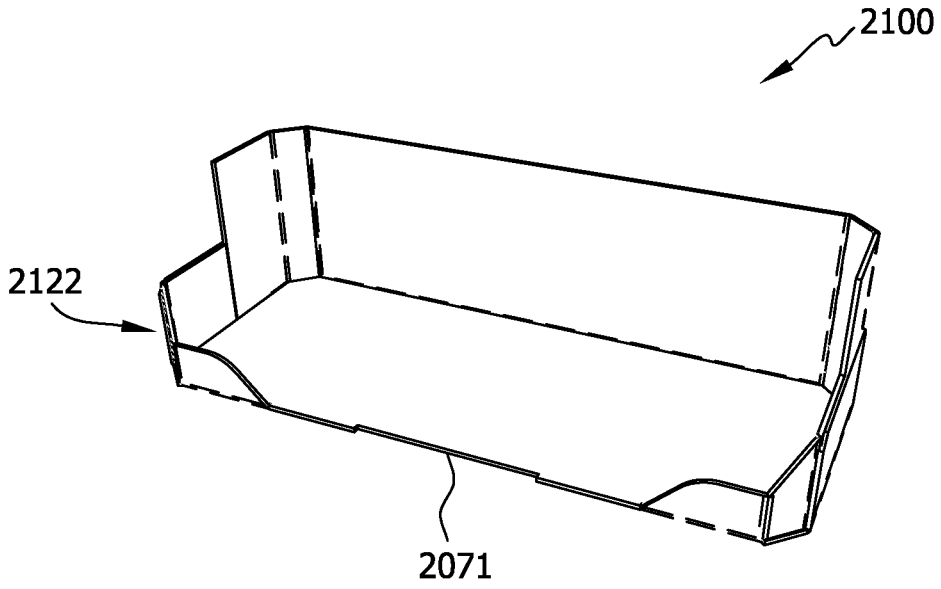
FIG. 21 is a perspective schematic illustration of a container formed from the blank shown in FIG. 20 that has been converted to a display container.

FIG. 20 is top plan schematic illustration of a blank 2000 of sheet material of a tenth alternate embodiment, and FIG. 21 is a perspective schematic illustration of a container 2100 formed from blank 2000, and that has been converted to a display container. The tenth alternate embodiment is substantially similar to the embodiment of FIGS. 17 and 18, except that no opening lip is provided in the back rear panel. Blank 2000 includes glue flap 2018, first side panel 2010, front end panel 2012, second side panel 2014, and back end panel 2016, as well as first top side panel 2030, first bottom side panel 2032, front top end panel 2050, front bottom end panel 2052, second top side panel 2040, second bottom side panel 2042, back top end panel 2060 and back bottom end panel 2062, as well as fold lines 2022, 2025, 2027, 2054, 2056, 2058, 2059, 2064, 2066, 2068, and 2073. In addition, blank 2000 includes perforations 2020, 2034, 2036, 2074, 2024, 2026, 2076, 2044, and 2046. Blank 2000 includes an opening assembly 2069 that includes opening lip 2070 (defined by cut 2082) on front end panel 2012. As discussed with respect to the embodiment of FIGS. 1 and 2, opening lip 2070 preferably extends into the adjacent panel a length equal or greater to the thickness of blank 2000, so as to extend beyond the adjacent wall of the erected container.

Articulation and gluing of blank 2000, in a manner similar to that of the embodiment of FIG. 17, results in container 2100, the lower portion 2122 of which is shown in FIG. 21. As with the other embodiments, upon articulation of blank 2000, the projection of opening lip 2070 creates a gap 2071 (FIG. 21), so that an operator may insert their fingers "behind" opening lip 2070, to enable removal of the upper portion (not shown) of container 2100 by lifting up on opening lip 2070, and subsequently lifting up the top portion, tearing it away along the several lines of perforations previously described.

Figure 22:
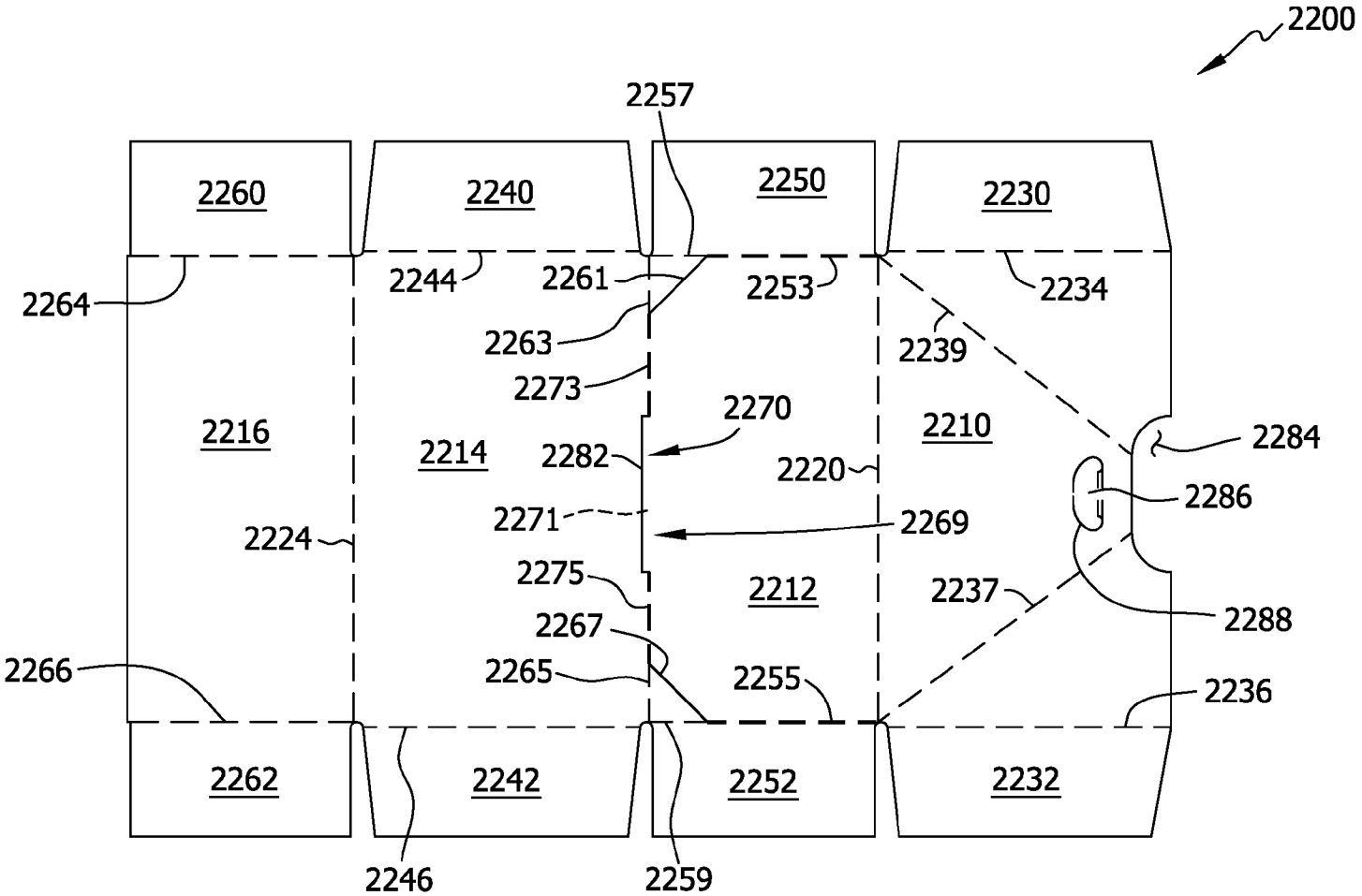
FIG. 22 is top plan schematic illustration of a blank of sheet material of an eleventh alternate embodiment.

FIG. 22 is top plan schematic illustration of a blank 2200 of sheet material of an eleventh alternate embodiment. The eleventh alternate embodiment is similar to the exemplary embodiment shown in FIGS. 20 and 21. Blank 2200 includes first side panel 2210, front end panel 2212, second side panel 2214 and back end panel 2216, as well as first top side panel 2230, first bottom side panel 2232, front top end panel 2250, front bottom end panel 2252, second top side panel 2240, second bottom side panel 2242, back top end panel 2260 and back bottom end panel 2262. Blank 2200 also includes fold lines 2234, 2236, 2220, 2257, 2263, 2265, 2259, 2244, 2246, 2224, 2264 and 2266, as well as perforations 2237, 2239, 2253, 2255, 2273, 2275, and cuts 2261, 2282 and 2267. Blank 2200 also includes cutaway 2284, and knock-out tab 2286 defined by perforation 2288. Blank 2200 further includes an opening assembly 2269 that includes opening lip 2270 (defined by cut 2282) on front end panel 2212.

Articulation of blank 2200 into a container (not shown) is similar to that of blank 2000 of the embodiment of FIGS. 20 and 21, but without the use of a glue flap. Opening of the container may be accomplished by grasping under cutaway 2284, pushing in knock-out tab 2286, and/or slipping fingers into access gap 2271 created by opening lip 2270. As discussed with respect to the embodiment of FIGS. 1 and 2, opening lip 2270 preferably extends into the adjacent panel a length equal or greater to the thickness of blank 2200, so as to extend beyond the adjacent wall of the erected container.

Figure 23:
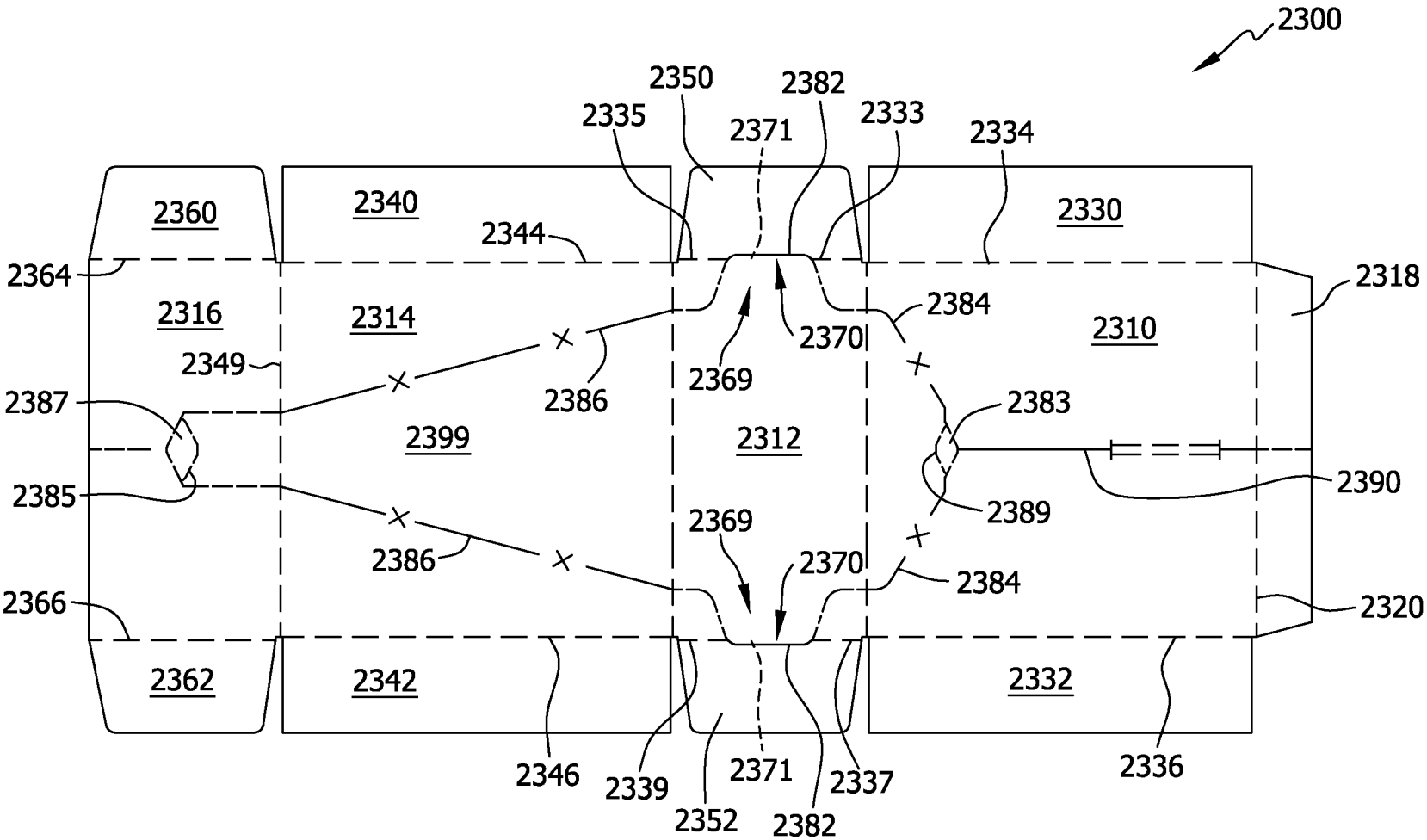
FIG. 23 is top plan schematic illustration of a blank of sheet material of a twelfth alternate embodiment.
Figure 24:
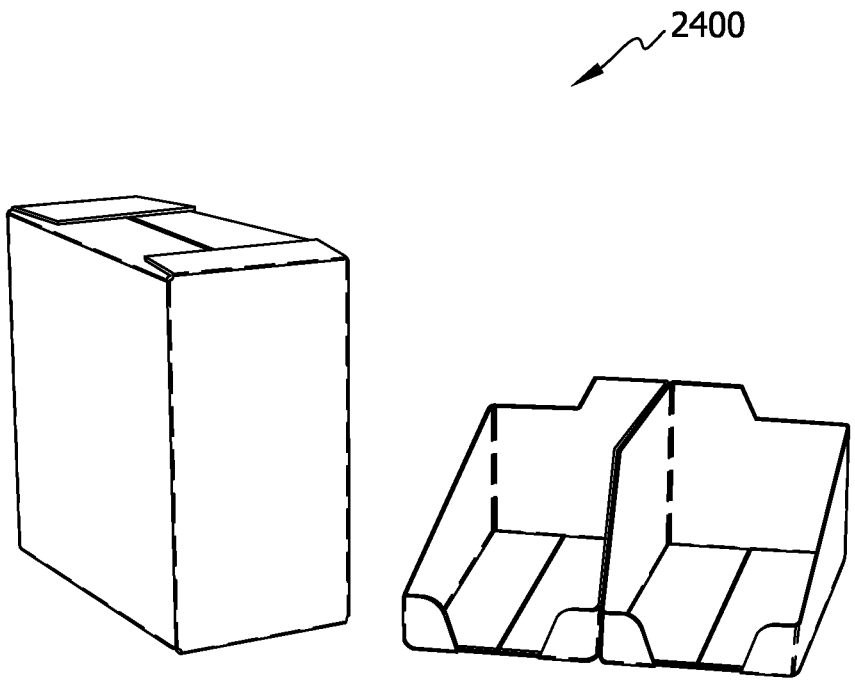
FIG. 24 is a perspective schematic illustration of a container formed from the blank shown in FIG. 23, and the container that has been converted to a display container.

FIG. 23 is top plan schematic illustration of a blank 2300 of sheet material of a twelfth alternate embodiment, and FIG. 24 is a perspective schematic illustration of a container 2400 formed from blank 2300, and container 2400 that has been converted to side by side display elements of container 2400. Blank 2300 includes glue flap 2318, first side panel 2310, front end panel 2312, second side panel 2314 and bottom end panel 2316, as well as first top side panel 2330, first bottom side panel 2332, front top end panel 2350, front bottom end panel 2352, second top side panel 2340, second bottom side panel 2342, back top end panel 2360, and back bottom end panel 2362. Blank 2300 further includes fold lines 2320, 2333, 2334, 2335, 2336, 2337, 2339, 2344, 2346, 2349, 2364 and 2366; perforations 2384, 2385, 2386, and 2389, and push in tabs 2383 and 2387.

Blank 2300 further includes opening assemblies 2369 that include opening lips 2370 (defined by cuts 2382) and access gaps 2371 on both ends of front end panel 2312. As discussed with respect to the embodiment of FIGS. 1 and 2, opening lips 2370 preferably extend into the adjacent panels a length equal or greater to the thickness of blank 2300, so as to extend beyond the adjacent walls of the erected container.

Articulation of blank 2300 into container 2400 is generally similar to that of blank 2000 of the embodiment of FIGS. 20 and 21. However, the loading of goods into container 2400 is intended to be such that the individual articles are interdigitated, so that upon opening of container 2400, and folding along fold line 2390, into its two complementary halves (FIG. 24, right side), articles for display are contained in each half. Opening is accomplished by grasping at either of the opening assemblies 2369, via opening lips 2370 and access gaps 2371, or by pushing in either or both of push-in tabs 2383 or 2387, and subsequently tearing away strip 2399 (which extends across first side panel 2310, front end panel 2312, second side panel 2314 and bottom end panel 2316), to enable container 2400 to be folded as just described.

Figure 25:
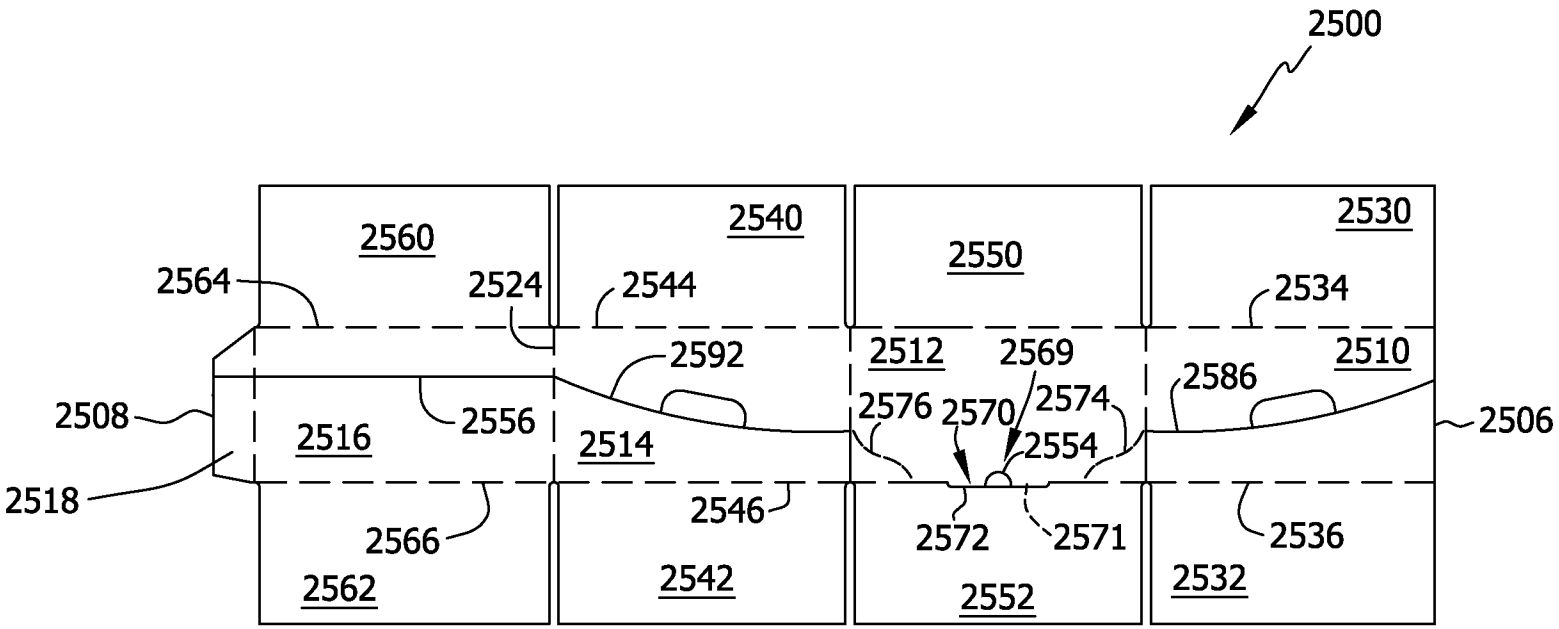
FIG. 25 is top plan schematic illustration of a blank of sheet material of a thirteenth alternate embodiment.
Figure 26:
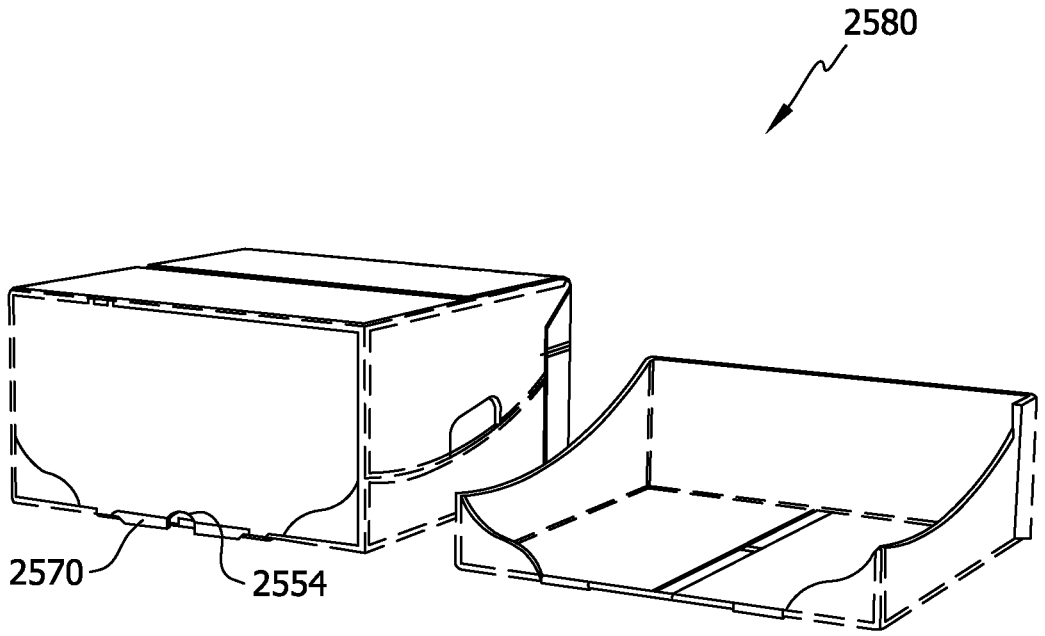
FIG. 26 is a perspective schematic illustration of a container formed from the blank shown in FIG. 25, and the container that has been converted to a display container.

FIG. 25 is top plan schematic illustration of a blank 2500 of sheet material of a thirteenth alternate embodiment, and FIG. 26 is a perspective schematic illustration of a container 2580 formed from blank 2500, and that has been converted to a display container. The thirteenth alternate embodiment is similar to the exemplary embodiment shown in FIGS. 1 and 2. Blank 2500 includes leading edge 2506, trailing edge 2508, first side panel 2510, front end panel 2512, second side panel 2514, rear end panel 2516, and glue flap 2518. Blank 2500 further includes first top side panel 2530, front top end panel 2550, second top side panel 2540, and top rear end panel 2560, as well as first side bottom panel 2532, front bottom end panel 2552, second bottom side panel 2542, and rear bottom end panel 2562, and fold lines 2564 and 2566. Blank 2500 also includes an opening assembly 2569 that includes lip 2570, formed by cut line 2572, and access gap 2571 on front end panel 2512. Blank also includes a crush tab (or cut out) 2554 in the bottom of front end panel 2512. Cut out 2554 is positioned in opening lip 2570. In addition, perforation line 2586 extends from the intersection of perforation line 2574 to the leading edge 2506 of first side panel 2510 between fold lines 2534 and 2536. Further, perforation line 2592 extends from the intersection of perforation line 2576 to fold line 2524 between fold lines 2544 and 2546. A perforation line 2556 extends from the end of perforation line 2592 through back end panel 2516, and through glue flap 2518 to the edge 2508 of glue flap 2518.

As discussed with respect to the embodiment of FIGS. 1 and 2, opening lip 2570 preferably extends into front bottom end panel 2552 a length equal or greater to the thickness of blank 2500, so as to extend beyond the bottom of the erected container.

Figure 27:
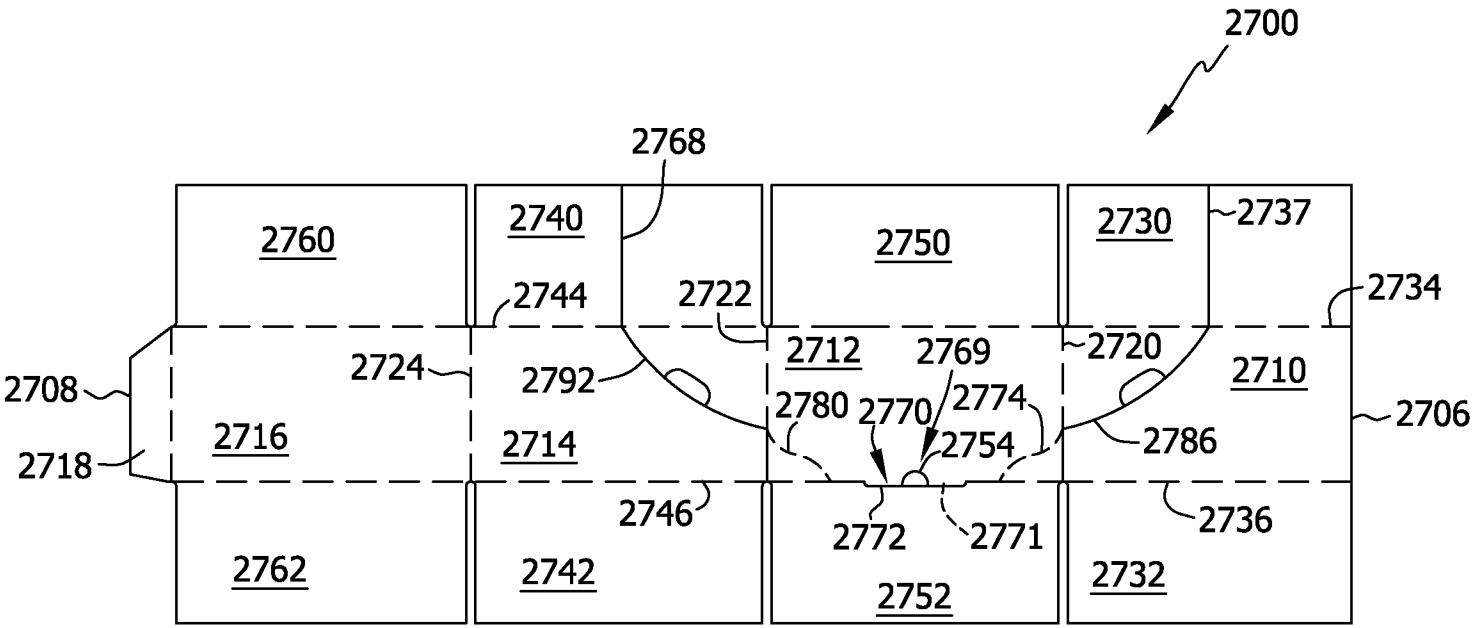
FIG. 27 is top plan schematic illustration of a blank of sheet material of a fourteenth alternate embodiment.
Figure 28:
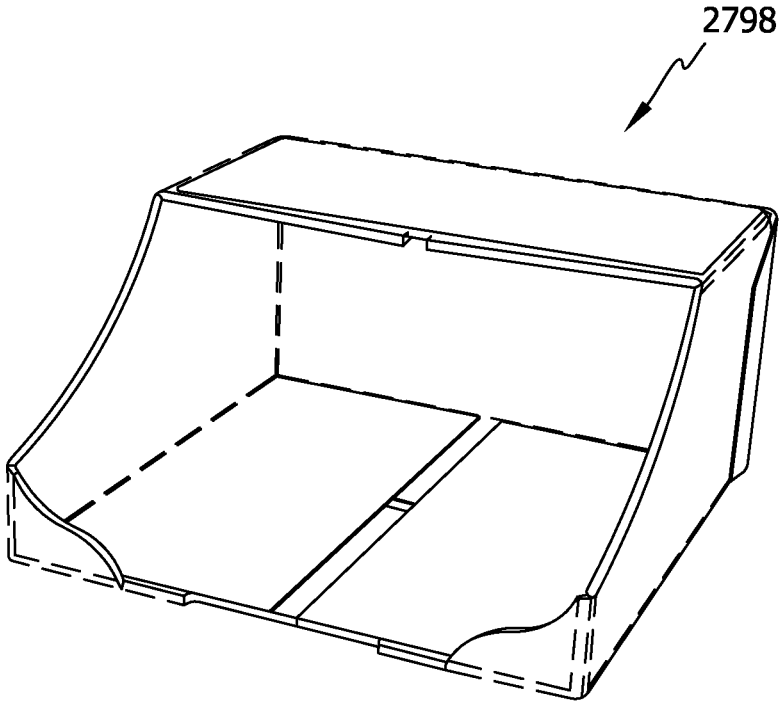
FIG. 28 is a perspective schematic illustration of a display container formed from the blank shown in FIG. 27.

FIG. 27 is top plan schematic illustration of a blank 2700 of sheet material of a fourteenth alternate embodiment, and FIG. 28 is a perspective schematic illustration of a container 2798 converted to a display container and formed from blank 2700. The fourteenth embodiment is similar to the exemplary embodiment shown in FIGS. 1 and 2. Blank 2700 includes first side panel 2710, front end panel 2712, second side panel 2714, and rear end panel 2716. Blank 2700 further includes first top side panel 2730, front top end panel 2750, second top side panel 2740, rear top end panel 2760, first side bottom panel 2732, fold line 2736, front bottom end panel 2752, second bottom side panel 2742, fold line 2746, rear bottom end panel 2762, glue flap 2718 and trailing edge 2708. Blank 2700 includes an opening assembly 2769 that includes lip 2770 (formed by cut line 2772) and access gap 2771 on front end panel 2712. Blank 2700 also includes a crush tab or cut out 2754 in the bottom of front end panel 2712. Crush tab/cut out 2754 is positioned in opening lip 2770. In addition, perforation line 2786 extends from the intersection of perforation line 2774 to fold line 2734 between fold line 2720 and leading edge 2706. A perforation line 2737 extends from the end of perforation line 2786 through first top side panel 2730. Further, perforation line 2792 extends from the intersection of perforation line 2780 to fold line 2744 between fold lines 2724 and 2722. A perforation line 2768 extends from the end of perforation line 2792 through second top side panel 2740.

As discussed with respect to the embodiment of FIGS. 1 and 2, opening lip 2770 preferably extends into front bottom end panel 2752 a length equal or greater to the thickness of blank 2700, so as to extend beyond the bottom of the erected container.

Figure 29:
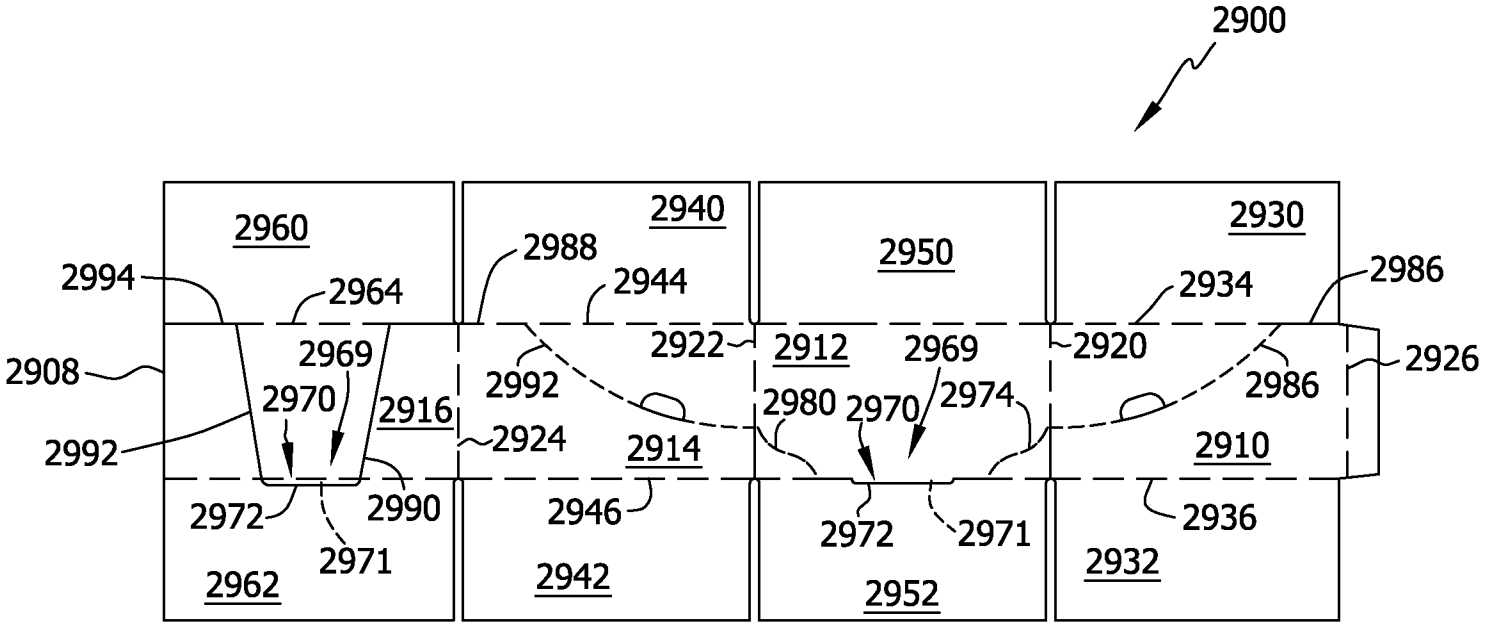
FIG. 29 is top plan schematic illustration of a blank of sheet material of a fifteenth alternate embodiment.
Figure 30:
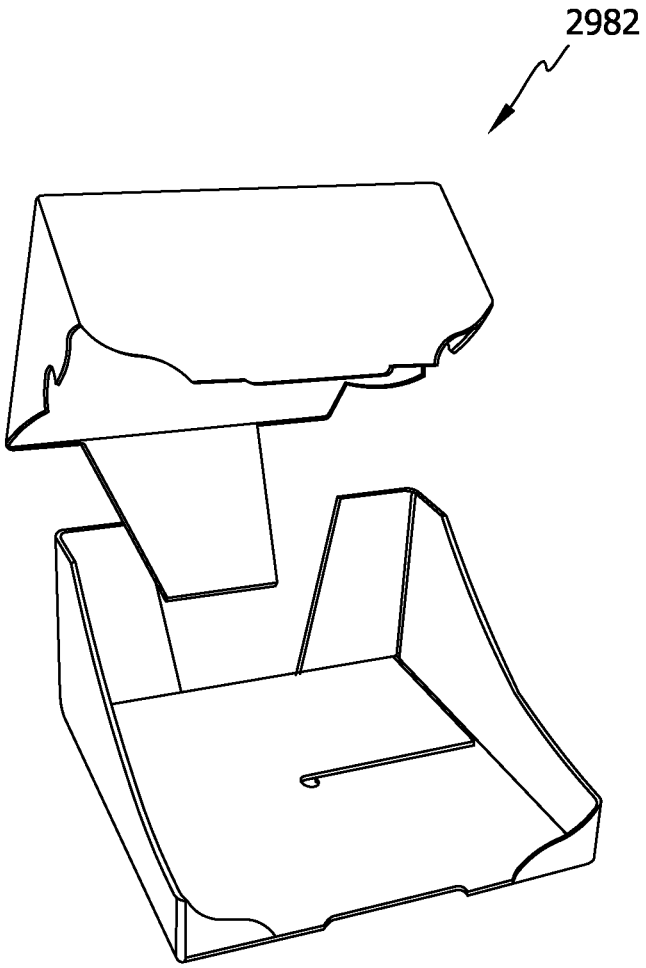
FIG. 30 is a perspective schematic illustration of a container formed from the blank shown in FIG. 29, and the container that has been converted to a display container.

FIG. 29 is top plan schematic illustration of a blank 2900 of sheet material of a fifteenth alternate embodiment, and FIG. 30 is a perspective schematic illustration of a container 2982 converted to a display container and formed from blank 2900. The fifteenth embodiment is similar to the exemplary embodiment shown in FIGS. 1 and 2. Blank 2900 includes first side panel 2910, front end panel 2912, second side panel 2914 and rear end panel 2916. Blank 2900 further includes first top side panel 2930, front top end panel 2950, second top side panel 2940, rear top end panel 2960, fold line 2936, first side bottom panel 2932, front bottom end panel 2952, fold line 2946, second bottom side panel 2942 and rear bottom end panel 2962. Blank 2900 further includes an opening assembly 2969 that includes lip 2970 (formed by cut line 2972) and access gap 2971 on front end panel 2912 and an opening assembly 2969 on rear end panel 2916. In addition, perforation line 2986 extends from the intersection of perforation line 2974 to fold line 2934 between fold lines 2920 and 2926. Further, perforation line 2992 extends from the intersection of perforation line 2980 to fold line 2944 between fold lines 2924 and 2922. A perforation line 2988 extends from the end of perforation line 2992 to a perforation line 2990 extending from one end of the lip 2970 in rear end panel 2916 to fold line 2964. Another perforation line 2992 extends from the other end of the lip 2970 in rear end panel 2916 to fold line 2964. A perforation line 2994 extends along fold line 2964 to end 2908 of blank 2900.

As discussed with respect to the embodiment of FIGS. 1 and 2, opening lip 2970 preferably extends into front bottom end panel 2952 a length equal or greater to the thickness of blank 2900, so as to extend beyond the bottom of the erected container. Similarly, opening lip 2970 (formed by cut line 2972) likewise extends into the rear bottom end panel 2962 beneath rear end panel 2916 a length equal to or greater than the thickness of blank 2900, so as to extend beyond the bottom of the erected container.

Figure 31:
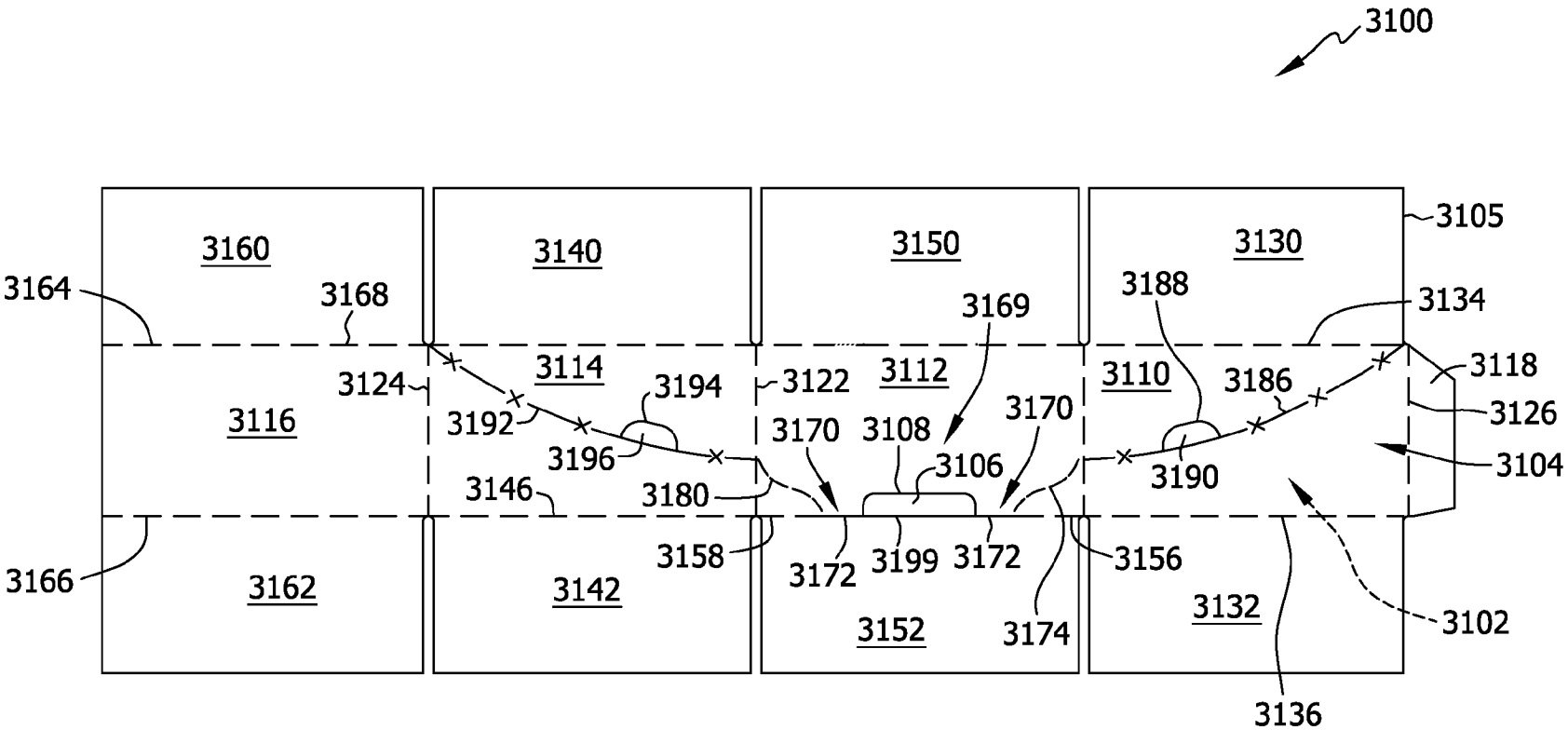
FIG. 31 is top plan schematic illustration of a blank of sheet material of a sixteenth alternate embodiment.
Figure 32:
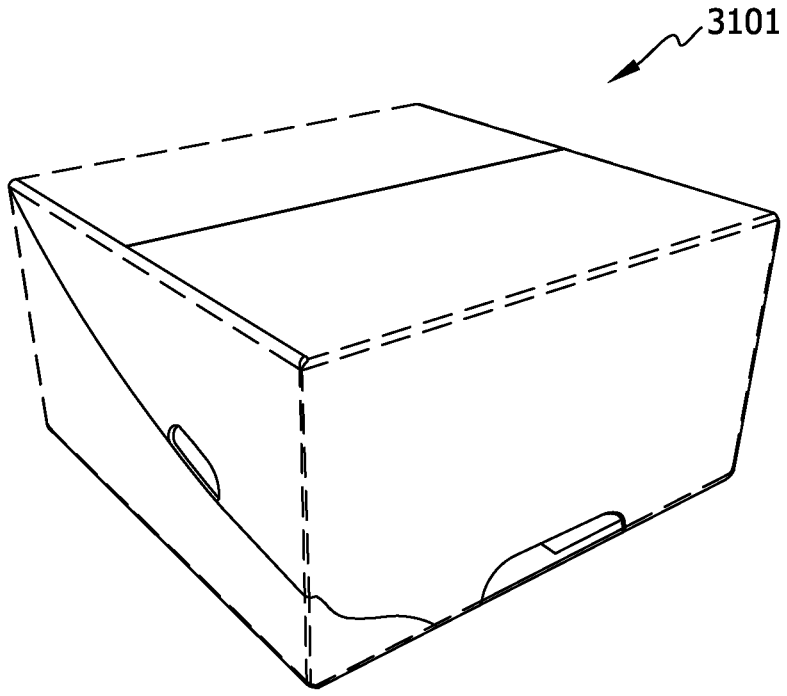
FIG. 32 is a perspective schematic illustration of a container formed from the blank shown in FIG. 31.

FIG. 31 is top plan schematic illustration of a blank 3100 of sheet material of a sixteenth alternate embodiment, and FIG. 32 is a perspective schematic illustration of a container 3101 formed from blank 3100. The sixteenth embodiment is similar to the exemplary embodiment shown in FIGS. 1 and 2. Blank 3100 includes leading edge 3105, inside surface 3102, outside surface 3104, glue flap 3118, panels 3110, 3112, 3114, 3116, 3130, 3132, 3150, 3140, 3160, 3162, 3142, 3152 and 3174. Blank 3100 further includes fold lines 3134, 3126, 3136, 3166, 3122, 3146, and 3124, as well as perforations 3186, 3174, 3180 and 3192, and openings 3190 and 3196 formed by cuts 3188 and 3194. Blank 3100 includes an opening assembly 3169 that includes a cut-out 3106 formed from an arcuate cut line 3108 on front end panel 3112 and cut/ crease 3199, resulting in two opening lips 3170 on either side of cut-out 3106. Cut/crease 3199 extends out from either side of cut line 3108 along fold lines 3156 and 3158. In addition, fold line 3164 includes perforation/cut line 3168.

As discussed with respect to the embodiment of FIGS. 1 and 2, opening lips 3170 (formed by cut lines 3172) preferably extend into front bottom end panel 3152 a length equal or greater to the thickness of blank 3100, so as to extend beyond the bottom of the erected container.

Figure 33:
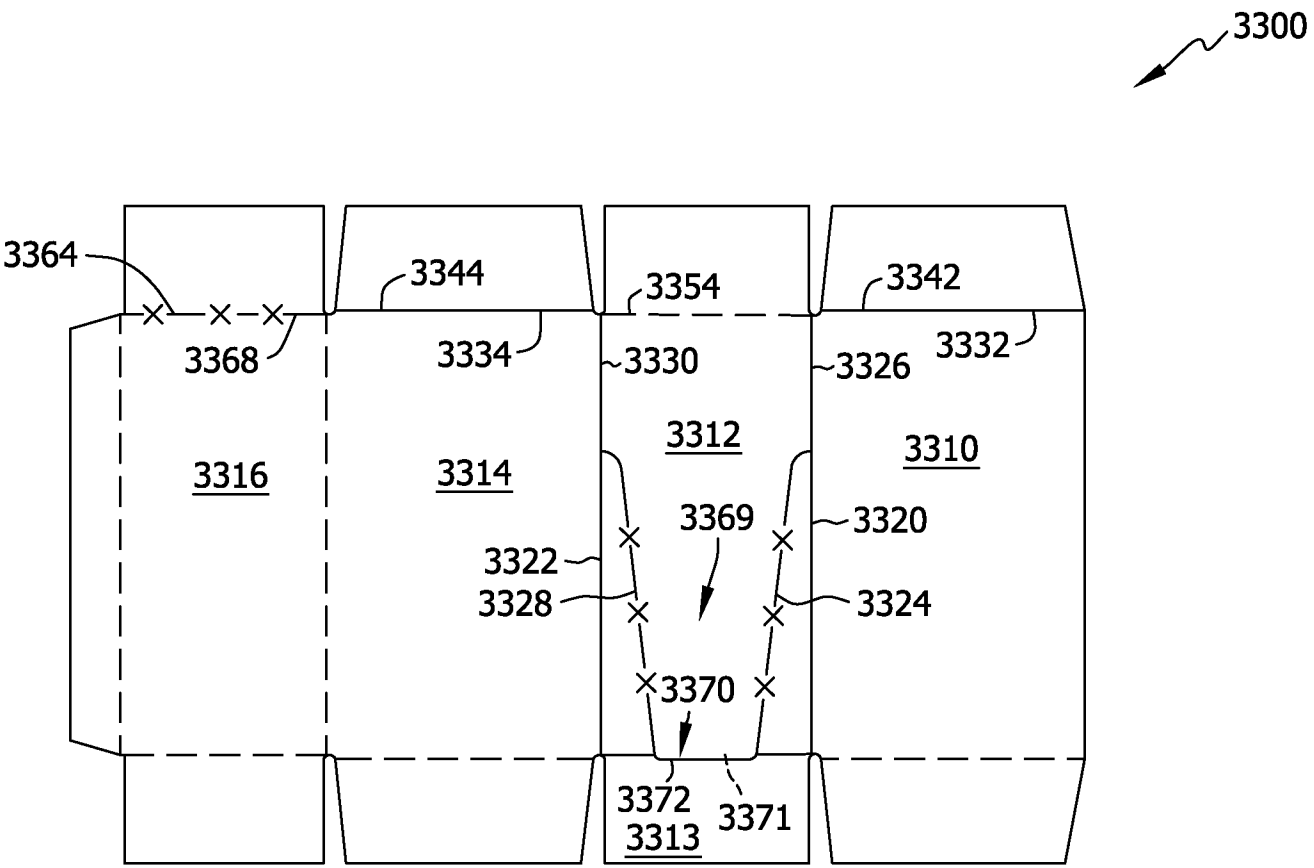
FIG. 33 is top plan schematic illustration of a blank of sheet material of a seventeenth alternate embodiment.
Figure 34:
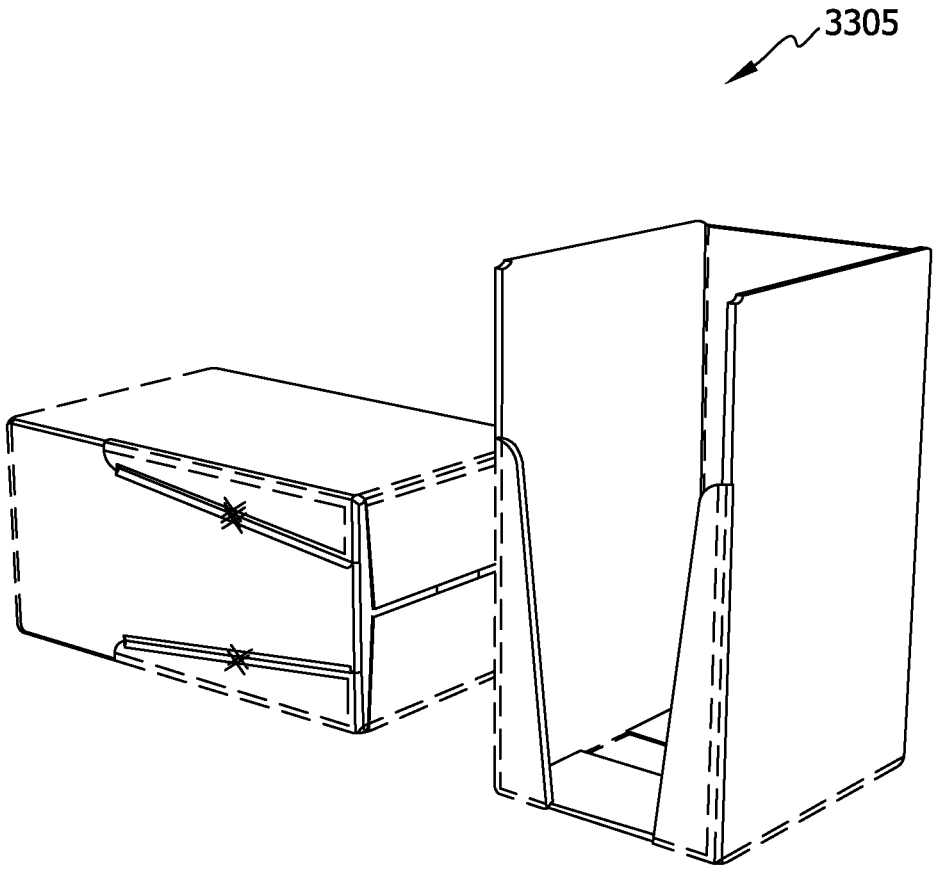
FIG. 34 is a perspective schematic illustration of a container formed from the blank shown in FIG. 33, and the container that has been converted to a display container.

FIG. 33 is top plan schematic illustration of a blank 3300 of sheet material of a seventeenth alternate embodiment, and FIG. 34 is a perspective schematic illustration of a container 3305 formed from blank 3300, and that has been converted to a display container. The seventeenth alternate embodiment is similar to the exemplary embodiment shown in FIGS. 1 and 2. Blank 3300 includes first side panel 3310, front end panel 3312, second side panel 3314 and rear end panel 3316. Blank 3300 also includes an opening assembly 3369 that includes lip 3370 and access gap 3371 on front end panel 3312. A cut line 3372 defines lip 3370. A perforation line 3324 extends diagonally from one end of cut line 3372 to fold line 3320. A zipper line 3326 extends along fold line 3320 from the intersection of perforation line 3324 and fold line 3320 to fold line 3354. A perforation line 3328 extends diagonally from the other end of cut line 3372 to fold line 3322. A zipper line 3330 extends along fold line 3322 from the intersection of perforation line 3328 and fold line 3322 to fold line 3354. In addition, fold line 3342 includes a zipper line 3332 and fold line 3344 includes a zipper line 3334. Further, fold line 3364 includes perforation/cut line 3368.

As discussed with respect to the embodiment of FIGS. 1 and 2, opening lip 3370 preferably extends into front bottom end panel 3313 a length equal or greater to the thickness of blank 3300, so as to extend beyond the bottom of the erected container.

Figure 35:
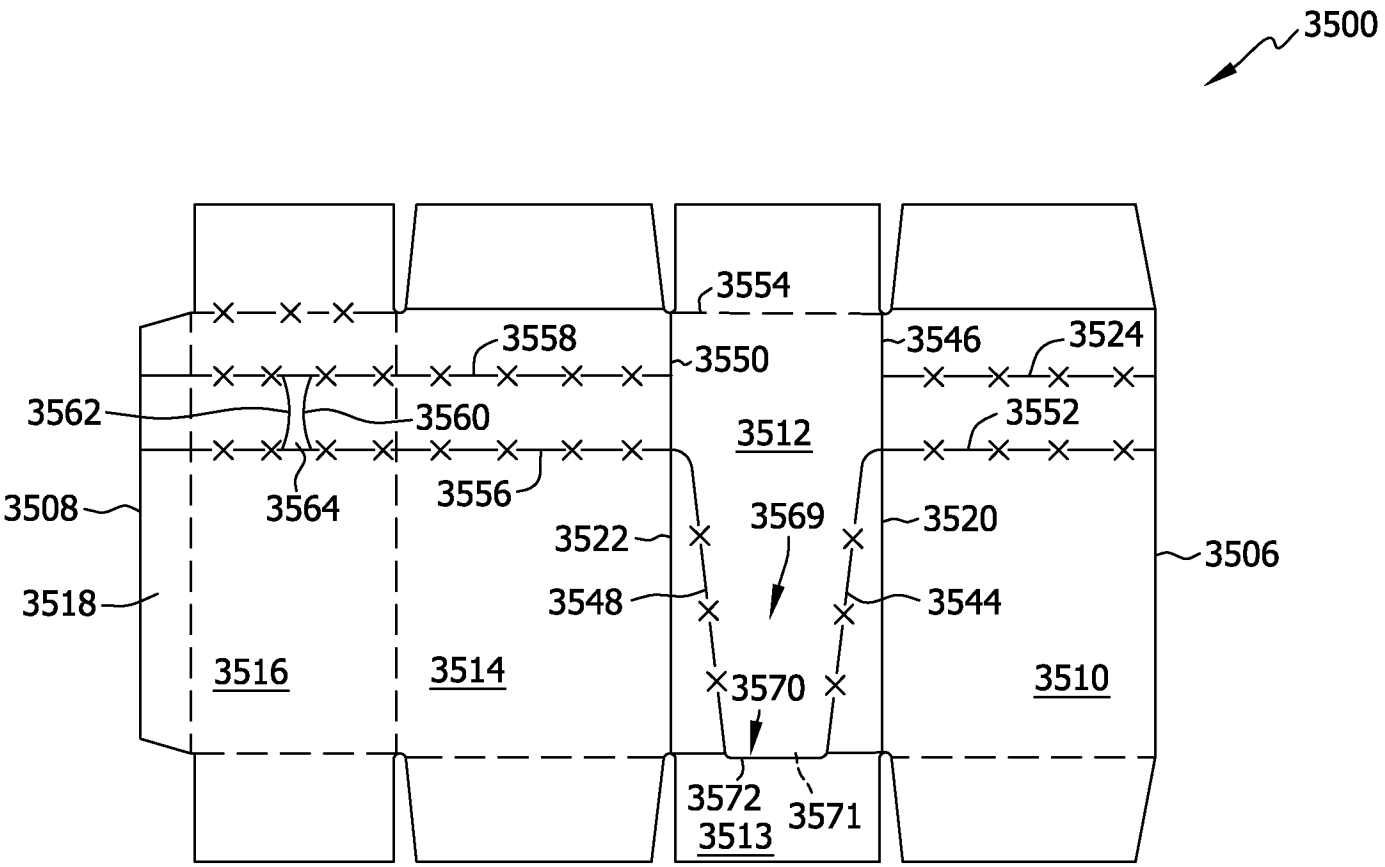
FIG. 35 is top plan schematic illustration of a blank of sheet material of an eighteenth alternate embodiment.
Figure 36:
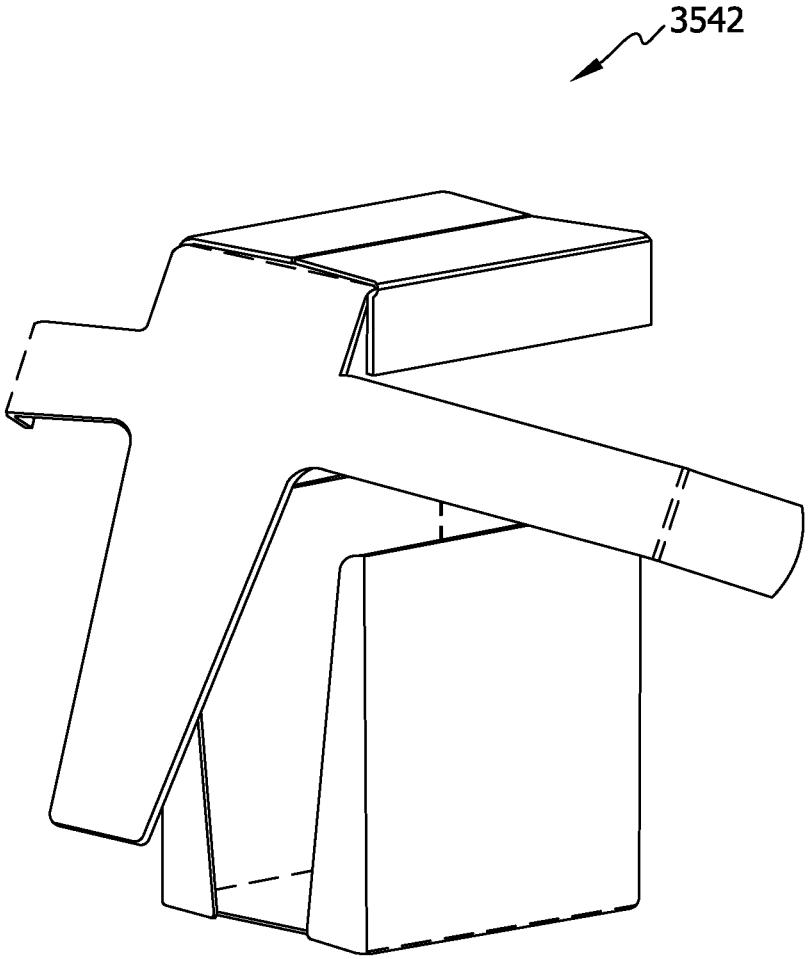
FIG. 36 is a perspective schematic illustration of a container formed from the blank shown in FIG. 35, and the container that has been converted to a display container.

FIG. 35 is top plan schematic illustration of a blank 3500 of sheet material of an eighteenth embodiment, and FIG. 36 is a perspective schematic illustration of a container 3542 formed from blank 3500, and that has been converted to a display container. The eighteenth alternate embodiment is similar to the exemplary embodiment shown in FIGS. 1 and 2. Blank 3500 includes first side panel 3510, front end panel 3512, second side panel 3514, and rear end panel 3516. Blank 3500 further includes an opening assembly 3569 that includes lip 3570 and access gap 3571 on front end panel 3512. A cut line 3572 defines lip 3570. A perforation line 3544 extends diagonally from one end of cut line 3572 to fold line 3520. A zipper line 3546 extends along fold line 3520 from the intersection of perforation line 3524 and fold line 3520 to fold line 3554. A perforation line 3548 extends diagonally from the other end of cut line 3572 to fold line 3522. A zipper line 3550 extends along fold line 3522 from the intersection of perforation line 3558 and fold line 3522 to fold line 3554. First side panel 3510 includes two substantially parallel a zipper lines 3552 and 3554 extending from fold line 3520 to the leading edge 3506 of blank 3500. Perforation line 3552 extends from the intersection of perforation line 3544 and fold line 3520 to leading edge 3506 of blank 3500, and perforation line 3554 extends from zipper line 3546 to the leading edge 3506 of blank 3500. Also, a perforation line 3556 extends from the intersection of perforation line 3548 and fold line 3522, through second side panel 3514, back end panel 3516, and glue flap 3518 to trailing edge 3508 of blank 3500. A perforation line 3558 extends from zipper line 3550 through second side panel 3514, back end panel 3516, and glue flap 3518 to trailing edge 3508 of blank 3500. Perforation lines 3556 and 3558 are substantially parallel to each other. In addition, back end panel 3516 includes spaced apart arcuate cut lines 3560 and 3562 extending between perforation lines 3556 and 3558 that define a cut-out 3564.

As discussed with respect to the embodiment of FIGS. 1 and 2, opening lip 3570 preferably extends into front bottom end panel 3513 a length equal or greater to the thickness of blank 3500, so as to extend beyond the bottom of the erected container.

Figure 37:
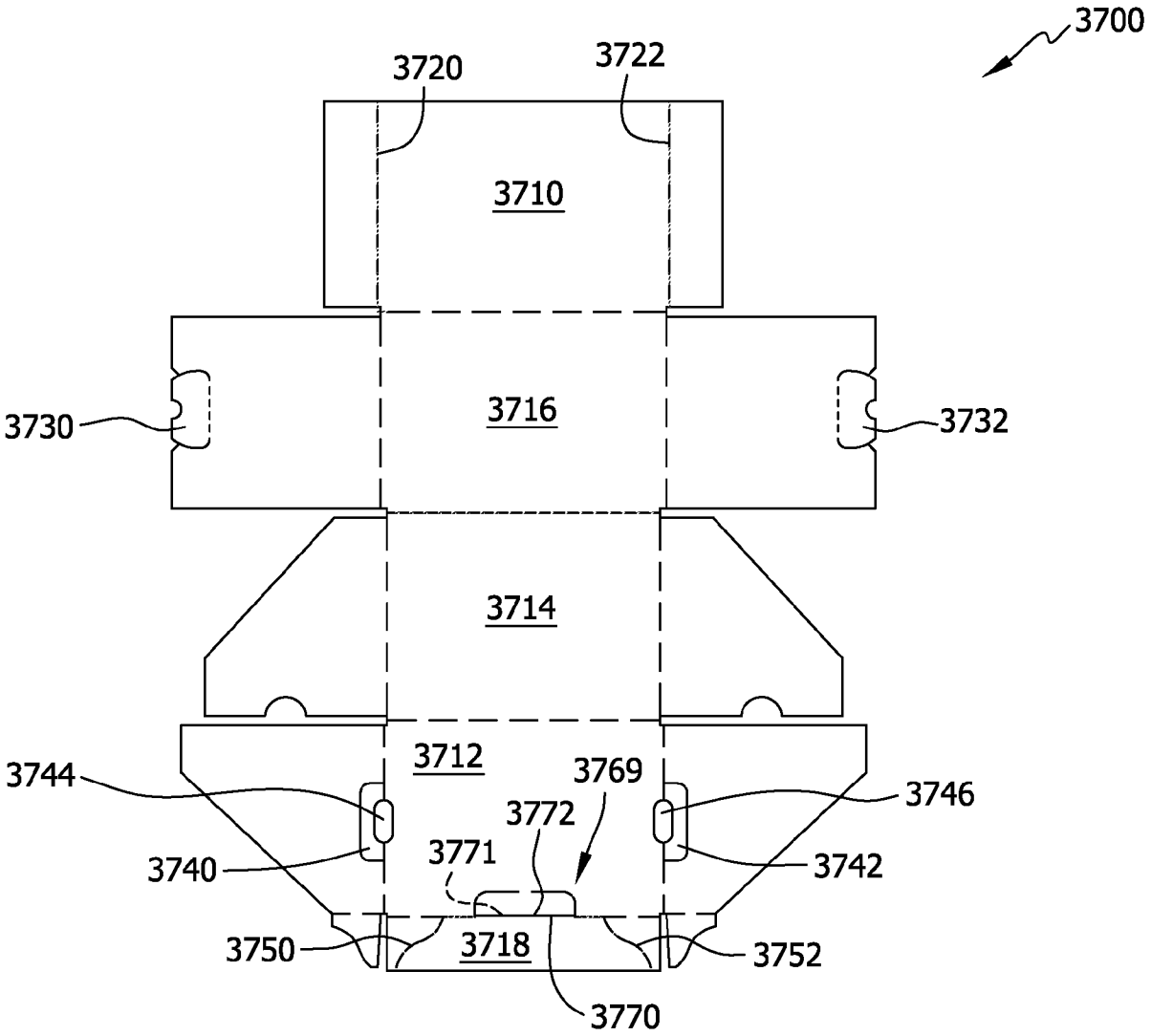
FIG. 37 is top plan schematic illustration of a blank of sheet material of a nineteenth alternate embodiment.
Figure 38:
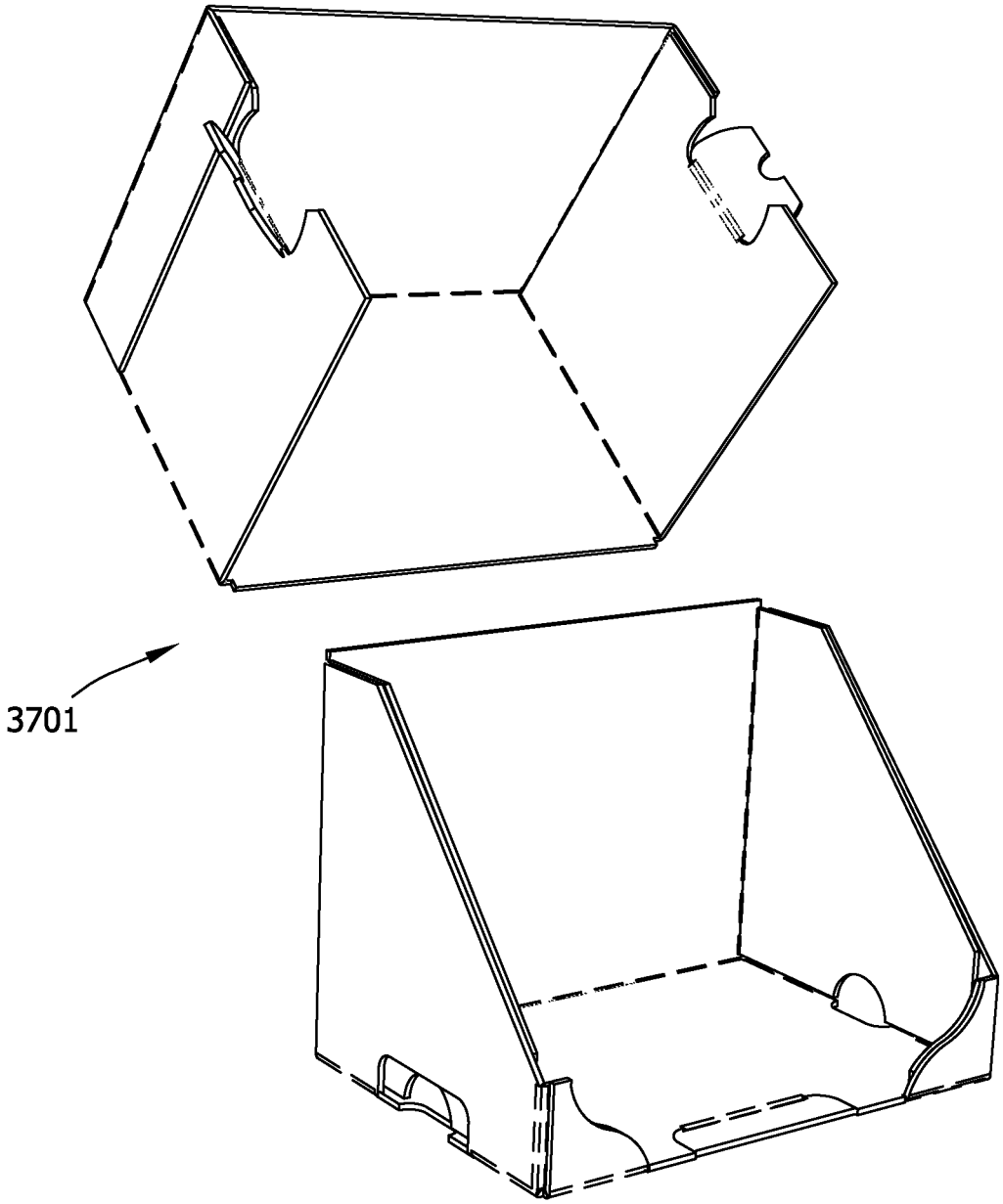
FIG. 38 is a perspective schematic illustration of a container formed from the blank shown in FIG. 37, and the container that has been converted to a display container.

FIG. 37 is top plan schematic illustration of a blank 3700 of sheet material of a nineteenth embodiment, and FIG. 38 is a perspective schematic illustration of a container 3701 formed from blank 3700, and that has been converted to a display container. Blank 3700 includes first side panel 3710, rear end panel 3716, second side panel 3714, front end panel 3712 and glue flap 3718, as well as perforation lines 3720, 3722, 3750, and 3752. Blank 3700 further includes cutouts 3744, 3746, and push-in/pull-out flaps 3740, 3742, 3730, and 3732. Front end panel 3712 further includes opening assembly 3769, which further includes opening lip 3770, formed by cut line 3772, and opening gap 3771. As discussed with respect to the embodiment of FIGS. 1 and 2, opening lip 3770 preferably extends into front end panel 3712 a length equal or greater to the thickness of blank 3700, so as to extend beyond the bottom of the erected container.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of sheet material for forming a container, the blank having a thickness, the blank comprising:

a front end panel, a first side panel, a second side panel, and a back end panel connected by a plurality of side fold lines;

a front bottom panel extending at least partially from a bottom edge of the front end panel;

the front end panel including a lip extending beyond the bottom edge of the front end panel to a free edge, the lip having two opposite ends, the lip being adjacent to the front bottom panel, each of the two opposite ends of the lip being a distance from the side fold lines of the front end panel, wherein the free edge of the lip is defined by a cut line extending from the bottom edge of the front end panel into the front bottom panel by at least the thickness of the blank such that upon articulation of the blank into the container, the lip is disposed in a first plane substantially parallel to the front end panel and extends at least to a second plane substantially parallel to an outer surface of the front bottom panel;

a first separation line extending from a first end of the opposite ends of the lip toward the first side panel; and a second separation line extending from a second end of the opposite ends of the lip toward the second side panel.

2. The blank according to claim 1, wherein the lip, upon articulation of the blank into a container, extends to a position that is below the second plane.

3. The blank according to claim 1, further comprising:
third and fourth separation lines extending from the first and second separation lines, respectively, through the first and second side panels; and
at least a fifth separation line disposed in the back end panel.

4. The blank according to claim 1, wherein the cut line extends into the front bottom end panel by more than the thickness of the blank.

5. The blank according to claim 1, further comprising:
at least one access opening disposed adjacent to the lip, in the front bottom end panel.

6. The blank according to claim 1, further comprising:
at least one access opening disposed adjacent to at least one of the first and second separation lines.

7. The blank according to claim 1, further comprising:
at least one removable access panel adjacent to the lip.

8. The blank according to claim 1 further comprising:
at least one removable access panel, disposed in one of the front end panel, the first and second side panels, and the back end panel, remote from the lip.

9. The blank according to claim 8 further comprising:
a knock-out tab, positioned adjacent to the removable access panel, to facilitate removal of the removable access panel.

10. The blank according to claim 1 further comprising:
a push-in tab disposed adjacent to the lip.

11. The blank according to claim 1 further comprising:
an access opening disposed in the front end panel, remote from the lip.

12. The blank according to claim 1 further comprising:
a second lip extending from the back end panel.

13. The blank according to claim 1 further comprising:
an attachment panel extending from a free edge of one of the first and second side panels, the back end panel.

14. A shipping container convertible to a display container, formed from a blank of sheet material, the blank having a thickness, the blank comprising:
a front end panel, a first side panel, a second side panel, and a back end panel connected by a plurality of side fold lines;
a front bottom panel extending at least partially from a bottom edge of the front end panel;
the front end panel including a lip extending beyond the bottom edge of the front end panel to a free edge, the lip having two opposite ends, the lip being adjacent to the front bottom panel, each of the two opposite ends of the lip being a distance from the side fold lines of the front end panel, wherein the free edge of the lip is defined by a cut line extending from the bottom edge of the front end panel into the front bottom panel by at least the thickness of the blank, and wherein the lip is disposed in a first plane substantially parallel to the front end panel and extends at least to a second plane substantially parallel to an outer surface of the front bottom panel;
a first separation line extending from a first end of the opposite ends of the lip toward the first side panel; and
a second separation line extending from a second end of the opposite ends of the lip toward the second side panel.

15. The shipping container according to claim 14, wherein the front bottom panel includes an interior surface and an exterior surface, and further wherein the lip, upon articulation of the blank into a container, extends to a position that is below the second plane.

16. The shipping container according to claim 14, the blank further comprising:
third and fourth separation lines extending from the first and second separation lines, respectively, through the first and second side panels; and
at least a fifth separation line disposed in the back end panel.

17. The shipping container according to claim 14, wherein the cut line extends into the front bottom end panel by more than the thickness of the blank.

18. The shipping container according to claim 14, the blank further comprising:
at least one access opening disposed adjacent to the lip, in the front bottom end panel.

19. The shipping container according to claim 14, the blank further comprising:
at least one access opening disposed adjacent to at least one of the first and second separation lines.

20. The shipping container according to claim 14, the blank further comprising:
at least one removable access panel adjacent to the lip.

21. The shipping container according to claim 14, the blank further comprising:
at least one removable access panel, disposed in one of the front end panel, the first and second side panels, and the back end panel, remote from the lip.

22. The shipping container according to claim 21, the blank further comprising:
a knock-out tab, positioned adjacent to the removable access panel, to facilitate removal of the removable access panel.

23. The shipping container according to claim 14, the blank further comprising:
a push-in tab disposed adjacent to the lip.

24. The shipping container according to claim 14, the blank further comprising:
an access opening disposed in the front end panel, remote from the lip.

25. The shipping container according to claim 14, the blank further comprising:
a second lip extending from the back end panel.

26. The shipping container according to claim 14, the blank further comprising:
an attachment panel extending from a free edge of one of the first and second side panels, the back end panel.

27. A shipping container convertible to a display container, the shipping container comprising:
a front end wall, a first side wall, a second side wall, a top wall, a bottom wall emanating at least partially from a bottom edge of the front end wall, and a back end wall;
the front end wall including a lip extending beyond the bottom edge of the front end wall to a free edge, the lip having two opposite ends, the lip being adjacent to a front region of the bottom wall, each of the two opposite ends of the lip being a distance from a respective side edge of the front end panel, wherein the lip is disposed in a first plane substantially parallel to the front end wall and extends at least to a second plane substantially parallel to an outer surface of the bottom wall;
a first separation line extending from a first end of the opposite ends of the lip toward the first side wall; and
a second separation line extending from a second end of the opposite ends of the lip toward the second side wall.

28. The shipping container according to claim 27, wherein the lip is formed by a cut extending from the front end wall bottom edge into the bottom wall.

29. The shipping container according to claim 27, further comprising:

at least one access opening disposed adjacent to the lip, in one of the top wall, the bottom wall, the first side wall, the second side wall.

* * * * *